US010880642B2

(12) United States Patent
Yazu

(10) Patent No.: US 10,880,642 B2
(45) Date of Patent: Dec. 29, 2020

(54) SOUND PICK-UP APPARATUS, MEDIUM, AND METHOD

(71) Applicant: Oki Electric Industry Co., Ltd., Tokyo (JP)

(72) Inventor: Takashi Yazu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/235,571

(22) Filed: Dec. 28, 2018

(65) Prior Publication Data

US 2019/0306619 A1 Oct. 3, 2019

(30) Foreign Application Priority Data

Mar. 28, 2018 (JP) ..... 2018-062672

(51) Int. Cl.
*H04R 3/00* (2006.01)
*G10L 21/0216* (2013.01)
*H04R 1/40* (2006.01)

(52) U.S. Cl.
CPC ..... *H04R 3/005* (2013.01); *G10L 21/0216* (2013.01); *H04R 1/406* (2013.01); *G10L 2021/02166* (2013.01); *H04R 2410/01* (2013.01)

(58) Field of Classification Search
CPC ..... H04R 3/005; H04R 1/406; H04R 1/32; H04R 1/326; H04R 2410/01; H04R 2410/05; H04R 1/22; H04R 1/222; H04R 1/24; H04R 1/245; H04R 1/26; H04R 1/40; H04R 25/40; H04R 25/407; H04R 2201/40; H04R 2201/401; H04R 2201/403; H04R 2201/405; G10L 21/0216; G10L 2021/02166; G06F 3/16; G06F 3/162; G06F 3/165; G06F 3/167; G06F 16/60;
(Continued)

(56) References Cited

U.S. PATENT DOCUMENTS 6,603,861 B1 * 8/2003 Maisano ..... H04R 25/407 381/122
2005/0152563 A1 7/2005 Amada et al.
(Continued)

FOREIGN PATENT DOCUMENTS

JP 2005-195955 A 7/2005
JP 2014-072708 A 4/2014

OTHER PUBLICATIONS

Futoshi Asano, "Sound technology series 16: Array signal processing for acoustics: localization, tracking and separation of sound sources", The Acoustical Society of Japan Edition, Corona publishing Co. Ltd, pp. 70-79, Feb. 25, 2011; English translation of section 4.1 General Form of Beamformer.

*Primary Examiner* — Leshui Zhang
(74) *Attorney, Agent, or Firm* — Rabin & Berdo, P.C.

(57) ABSTRACT

The sound pick-up apparatus has a first area sound pick-up unit configured to acquire, on a basis of an input signal from a microphone array unit capable of forming microphone arrays with three or more different directionalities, area sound pick-up outputs based on two or more patterns of combinations of the microphone arrays, and a second area sound pick-up unit configured to output, as an area sound pick-up result, a result obtained by integrating the area sound pick-up outputs of the respective patterns which are acquired by the first area sound pick-up unit.

11 Claims, 16 Drawing Sheets

(58) Field of Classification Search
CPC ..... G06F 16/61; G06F 16/632; G06F 16/634; G06F 16/635; G06F 16/636; G06F 16/637; G06F 16/638; G06F 16/639; G06F 16/64
USPC ..... 381/92, 71.1–71.14, 73.1, 74, 94.1–94.8, 381/119, 122; 455/569.1, 370, 569.2, 455/575.2, 575.3, 575.4; 700/94
See application file for complete search history.

(56) References Cited

U.S. PATENT DOCUMENTS

2016/0021478 A1* 1/2016 Katagiri ..... H04S 7/30 381/26
2016/0198258 A1* 7/2016 Katagiri ..... H04R 1/406 381/92
2016/0255444 A1* 9/2016 Bange ..... H04R 25/405 381/313
2017/0013357 A1* 1/2017 Katagiri ..... H04R 3/005

* cited by examiner

SOUND PICK-UP APPARATUS, MEDIUM, AND METHOD

CROSS REFERENCE TO RELATED APPLICATION(S)

This application is based upon and claims benefit of priority from Japanese Patent Application No. 2018-062672, filed on Mar. 28, 2018, the entire contents of which are incorporated herein by reference.

BACKGROUND

This invention relates to a sound pick-up apparatus, a medium, and a method, and can be applied, for example, to a voice communication system and the like used under a noise environment.

In the case where a voice communication system or a speech recognition application system is used under a noise environment, a surrounding noise that comes in at the same time as a necessary target voice is problematic to prevent favorable communication and reduce a speech recognition rate. Conventionally, the technology of preventing an unnecessary sound from coming in and acquiring a necessary target sound by separating/picking up only a sound in a specific direction under an environment in which a plurality of such sound sources are present includes a beam former (which will also be referred to as "BF" below; see Patent Literature 1 (JP 2014-072708A) and Patent Literature 2 (JP 2005-195955A)) that uses a microphone array. The BF is technology of forming directionality with a time lag between signals arriving at the respective microphones. However, it is difficult for a BF alone to pick up only a sound (which will be referred to as "target area sound" below) present in an area for the purpose of picking up a sound (which will be referred to as "target area" below) in the case where there are other sound sources around the target area. Therefore, conventionally, Patent Literatures 1 and 2 or the like have proposed an area sound pick-up scheme for picking up a sound in a target area with a plurality of microphone arrays.

FIG. 14 is an explanatory diagram illustrating a process of picking up a target area sound from a sound source in a target area with two microphone arrays MA100 and MA200. FIG. 14(*a*) is an explanatory diagram illustrating a configuration example of each of the microphone arrays MA100 and MA200. Each of FIGS. 14(*b*) and 14(*c*) is a diagram (image diagram in the form of a graph) illustrating BF outputs of the microphone arrays MA100 and MA200 illustrated in FIG. 14(*a*) in the frequency domain. In FIG. 14, each of the microphone arrays MA100 and MA200 includes two microphones ch1 and ch2.

In conventional area sound pick-up, as illustrated in FIG. 14(*a*), the directionalities of the microphone arrays MA100 and MA200 are crossed in an area (target area) in which it is desired to pick up sounds from different directions, and sounds are picked up. In the state of FIG. 14(*a*), the directionalities of the respective microphone arrays MA100 and MA200 include not only sounds (target area sounds) present in a target area, but also noises (non-target area sounds) in a target area direction. However, if, as illustrated in FIGS. 14(*b*) and 14(*c*), the directionalities of the microphone arrays MA100 and MA200 are compared in the frequency domain, target area sound components are included in both of the outputs, but non-target area sound components are different for each microphone array. The conventional area sound pick-up technology uses such characteristics to suppress components other than the components included in common in the BF outputs of the two microphone arrays MA100 and MA200, thereby making it possible to extract only target area sounds.

SUMMARY

Incidentally, as means for emergency contact with a command center (fire department headquarter) from fire sites and emergency scenes in which sirens are blown, emergency vehicles are equipped with handsets (transmitters and receivers) for communication. A conventional handset provided to an emergency vehicle is used under such a noisy use environment that surrounding noises drown out communication from the sites, and it is not possible to notify the headquarter (e.g., headquarter that leads a crew of an emergency vehicle) of accurate information, resulting in wrong information. This could prevent an accurate determination or cause a delay in movement. Therefore, it has been considered to use various kinds of noise removal technology for handsets, but leaves a large number of problems such as voice communication quality securement or increased costs for the introduction. In such a use environment, the area sound pick-up technology described above is expected as an effective solution. For example, two microphone arrays are installed around the mouthpiece of a handset, and the directionalities of the respective two microphone arrays are crossed in front of the mouthpiece to enable area sound pick-up to function, thereby making it possible to eliminate a loud noise such as a siren, and accurately notify a headquarter and the like of only the voice of a speaker such as a firefighter.

To achieve area sound pick-up, at least two microphone arrays are necessary. Meanwhile, in the case where the mouthpiece part of a handset is small in size with an outer diameter of approximately 6 cm, and two microphone arrays are mounted thereon to achieve area sound pick-up, it is necessary to install them in the state in which the respective microphone arrays are so close. As a result, in area sound pick-up that uses the handset, a sound pick-up area is limited to a considerably narrow area immediately close to the transmitter. However, in the case where the conventional area sound pick-up process is applied to the handset, each user (speaker) holds the handset differently or has different face size, so that the mouth can deviate from the narrow and limited sound pick-up area. In this case, once the mouth of the user (speaker) deviates from the sound pick-up area of the handset, the voices that are picked up are distorted or dropped, failing to stably pick up sounds.

In view of such a situation, a sound pick-up apparatus, a medium (program), and a method that can stably perform area sound pick-up are desired.

A sound pick-up apparatus according to an embodiment of the present invention includes (1) a first area sound pick-up unit that acquires, on the basis of an input signal from a microphone array unit capable of forming microphone arrays with three or more different directionalities, area sound pick-up outputs based on two or more patterns of combinations of the microphone arrays, and (2) a second area sound pick-up unit that outputs, as an area sound pick-up result, a result obtained by integrating the respective patterns of area sound pick-up outputs acquired by the first area sound pick-up unit.

A non-transitory computer-readable storage medium according to an embodiment of the present invention storing an ontology processing program causes a computer to function as (1) a first area sound pick-up unit configured to acquire, on a basis of an input signal from a microphone array unit capable of forming microphone arrays with three or more different directionalities, area sound pick-up outputs based on two or more patterns of combinations of the microphone arrays, and (2) a second area sound pick-up unit configured to output, as an area sound pick-up result, a result obtained by integrating the area sound pick-up outputs of the respective patterns which are acquired by the first area sound pick-up unit.

A sound pick-up method according to an embodiment of the present invention which is performed by a sound pick-up apparatus including a first area sound pick-up unit, and a second area sound pick-up unit, the sound pick-up method including acquiring, by the first area sound pick-up unit, on a basis of an input signal from a microphone array unit capable of forming microphone arrays with three or more different directionalities, area sound pick-up outputs based on two or more patterns of combinations of the microphone arrays, and outputting, by the second area sound pick-up unit, as an area sound pick-up result, a result obtained by integrating the area sound pick-up outputs of the respective patterns which are acquired by the first area sound pick-up unit.

According to an embodiment of the present invention, it is possible to provide a sound pick-up apparatus that efficiently and stably performs area sound pick-up.

DETAILED DESCRIPTION OF THE EMBODIMENT(S)

Figure 1:
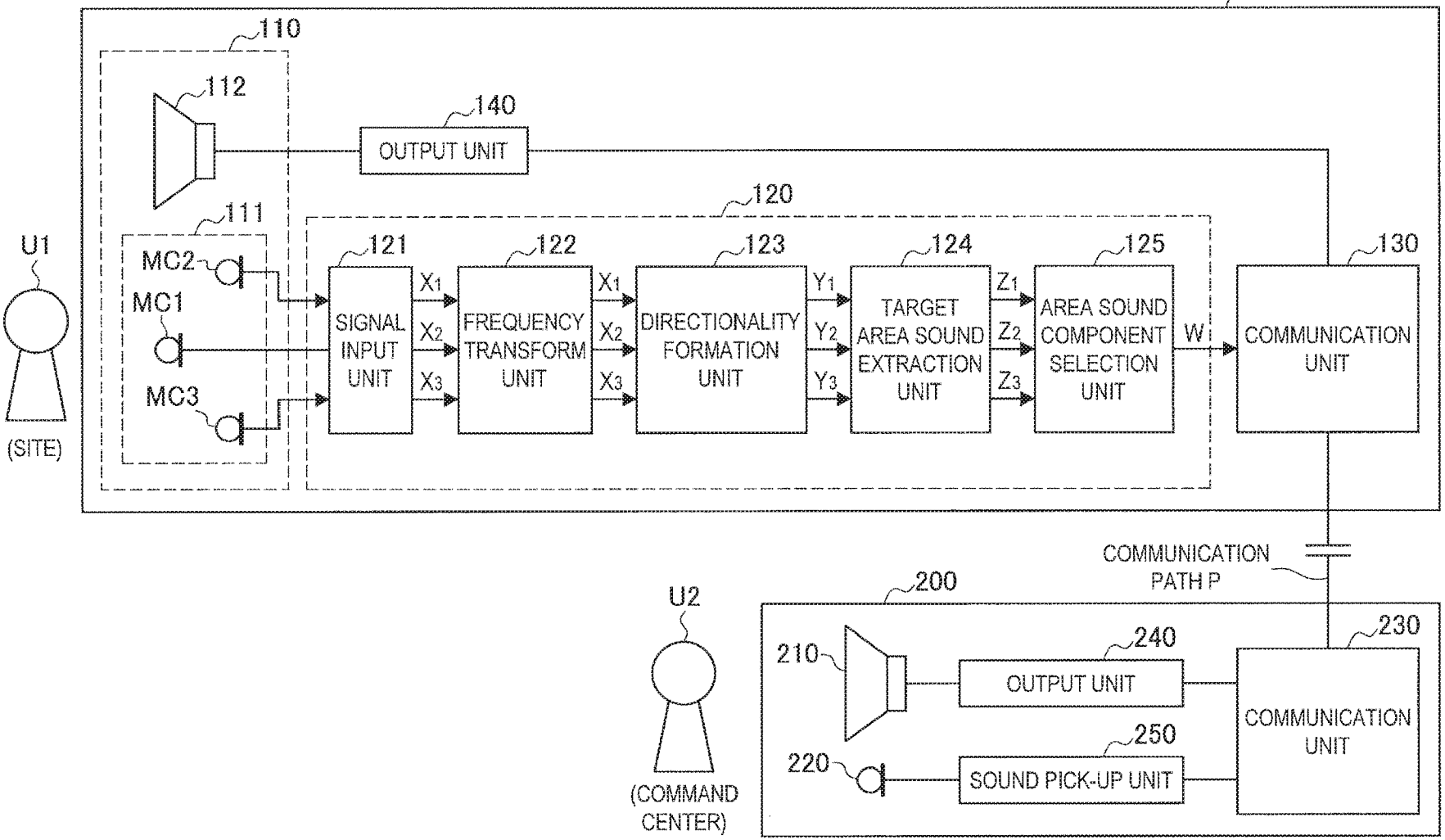
FIG. 1 is a block diagram illustrating a configuration (including a functional configuration of a sound pick-up unit (sound pick-up apparatus) according to a first embodiment) of each apparatus according to the first embodiment.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

(A) First Embodiment

THE following describes a sound pick-up apparatus, program (medium), and method according to a first embodiment of the present invention in detail with reference to the drawings. In this embodiment, an example will be described in which the sound pick-up apparatus, program (medium), and method according to the first embodiment of the present invention are applied to a sound pick-up unit.

First, the basic principle of an area sound pick-up process that uses a microphone array in this embodiment will be described by using FIGS. 4 to 6.

The inventor of the present application disposes a microphone at the position of each vertex of a polygon (N-sided polygon; N represents an integer greater than or equal to three), and defines a plurality of sound pick-up areas in the central direction of the polygon to use a difference in the degree of extension of each sound pick-up area to invent a method that makes it possible to pick up sounds in a wider area than a sound pick-up area defined by one combination of microphone arrays.

Figure 4:
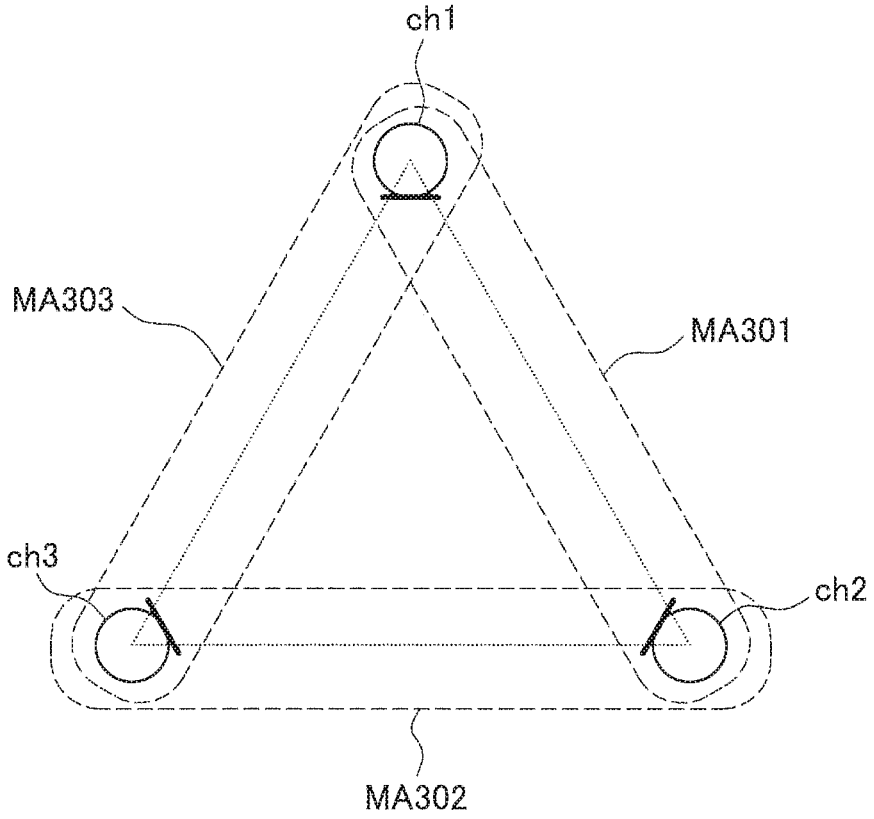
FIG. 4 is an explanatory diagram (image diagram) illustrating a configuration example of microphone arrays including three microphones.

For example, in the case of an area sound pick-up configuration (configuration in which a microphone is disposed at the position of each vertex of a triangle) that uses three microphones are used, as illustrated in FIG. 4, microphones are combined to make it possible to set three microphone arrays (three microphone arrays having different directionality directions). As illustrated in FIG. 4, with respect to three microphones ch1 to ch3, it is possible to set a microphone array MA301 that has the microphones ch1 and ch2 as a pair, a microphone array MA302 that has the microphones ch2 and ch3 as a pair, and a microphone array MA303 that has the microphones ch3 and ch1 as a pair.

Figure 5A:
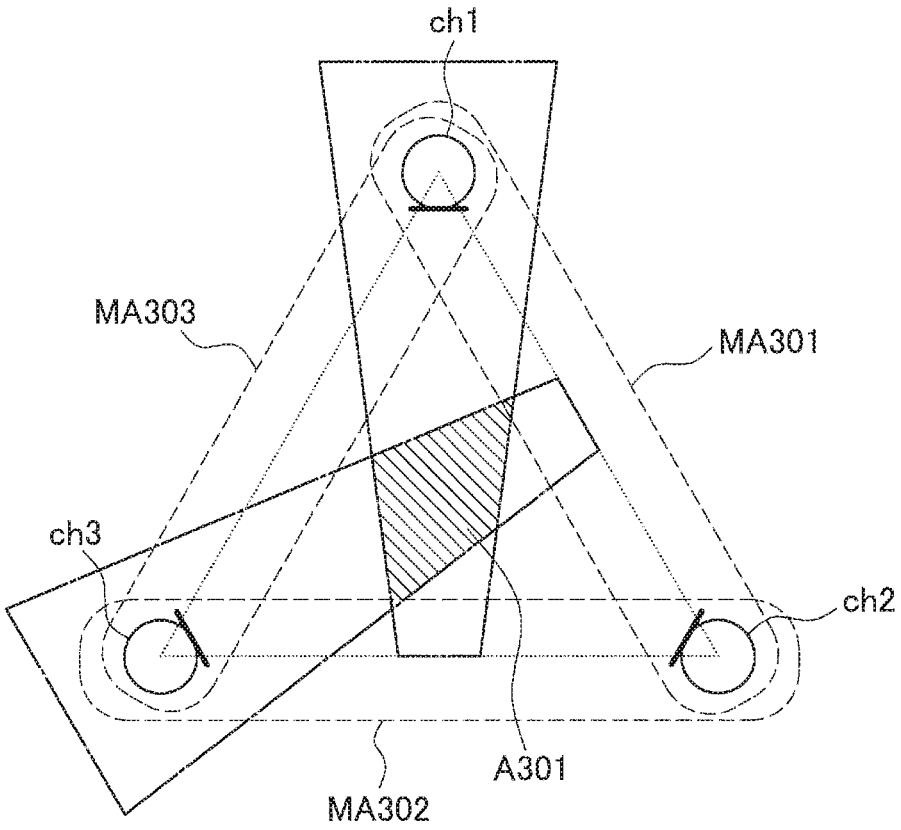
FIG. 5A is a (first) explanatory diagram (image diagram) illustrating an area sound pick-up process corresponding to each combination (combination pattern) of microphone arrays including three microphones.
Figure 5B:
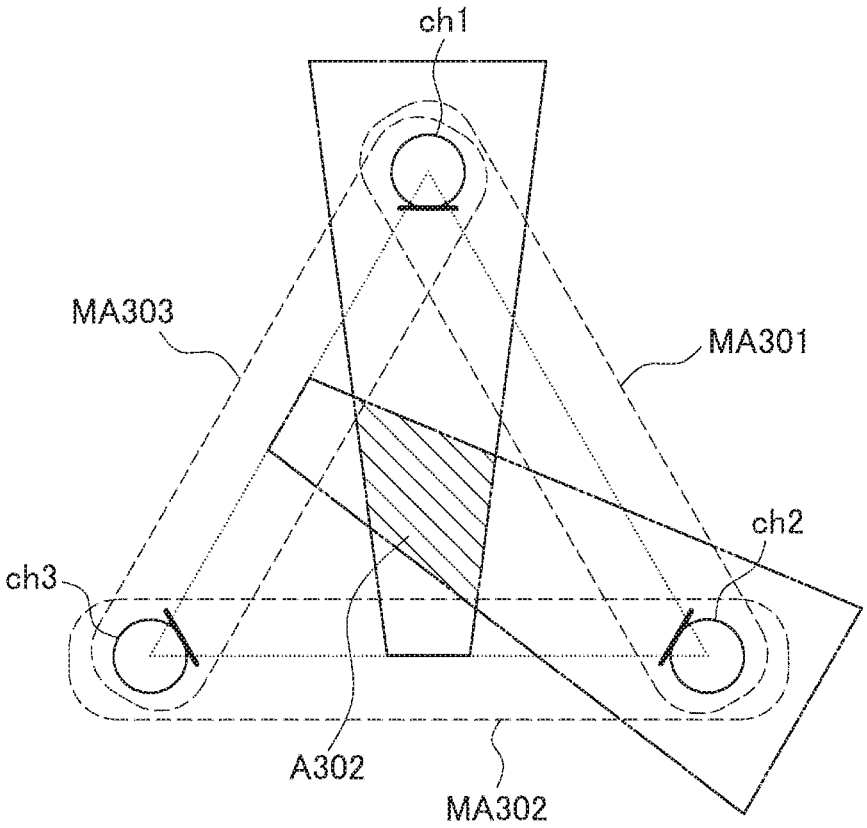
FIG. 5B is a (second) explanatory diagram (image diagram) illustrating an area sound pick-up process corresponding to each combination (combination pattern) of microphone arrays including three microphones.
Figure 5C:
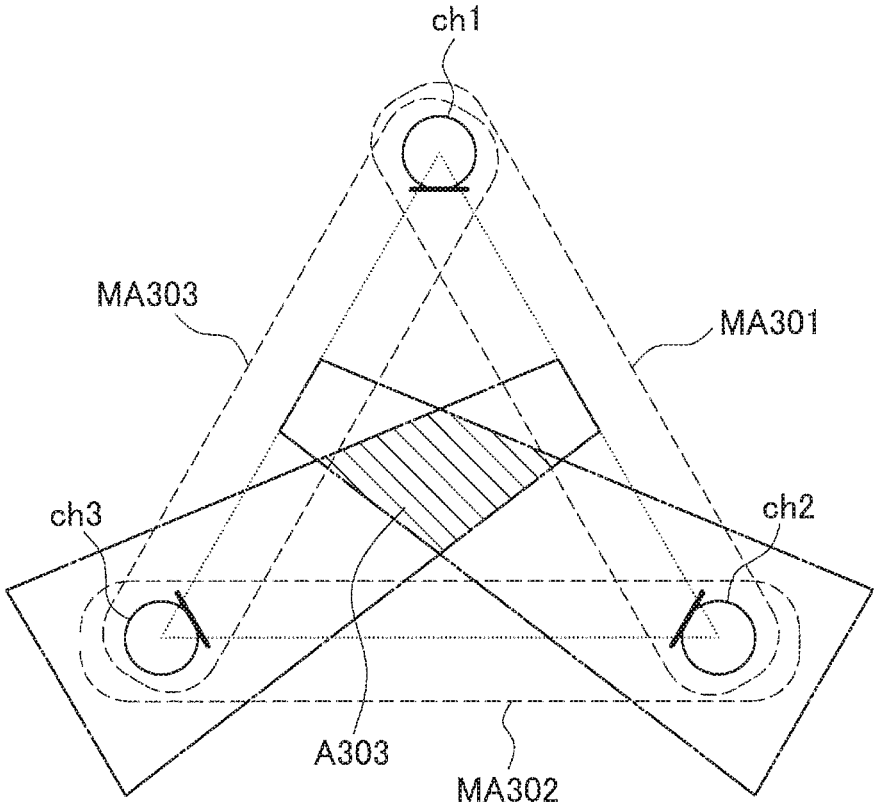
FIG. 5C is a (third) explanatory diagram (image diagram) illustrating an area sound pick-up process corresponding to each combination (combination pattern) of microphone arrays including three microphones.

Further, in the configuration of the three microphones ch1 to ch3, as illustrated in FIGS. 5A to 5C, it is possible to perform the area sound pick-up corresponding to the combinations of the three microphone arrays MA301, MA302, and MA303 (three combination patterns).

FIG. 5A illustrates the directionality of the microphone array MA301 as a one-dot chain line, and the directionality of the microphone array MA302 as a two-dot chain line. In addition, FIG. 5B illustrates the directionality of the microphone array MA302 as a one-dot chain line, and the directionality of the microphone array MA303 as a two-dot chain line. Further, FIG. 5C illustrates the directionality of the microphone array MA301 as a one-dot chain line, and the directionality of the microphone array MA303 as a two-dot chain line. Moreover, FIG. 5A hatches (oblique lines) a sound pick-up area A301 corresponding to the combination (pattern) of the microphone arrays MA301 and MA302. In addition, FIG. 5B hatches (oblique lines) a sound pick-up area A302 corresponding to the combination (pattern) of the microphone arrays MA302 and MA303. Further, FIG. 5C hatches (oblique lines) a sound pick-up area A303 corresponding to the combination (pattern) of the microphone arrays MA301 and MA303.

As illustrated in FIGS. 5A to 5C, in the configuration of the three microphones ch1 to ch3, any of the microphone arrays has an angle with a microphone array (segment connecting the positions of two microphones included in a microphone array), so that it is possible to cross the directionalities thereof and achieve area sound pick-up different for each combination (area sound pick-up in different regions).

Meanwhile, a sound pick-up area for area sound pick-up that uses a microphone array characteristically extends ahead of the microphone array (distant from the microphone array). The following describes that characteristic by using FIG. 6.

Figure 6:
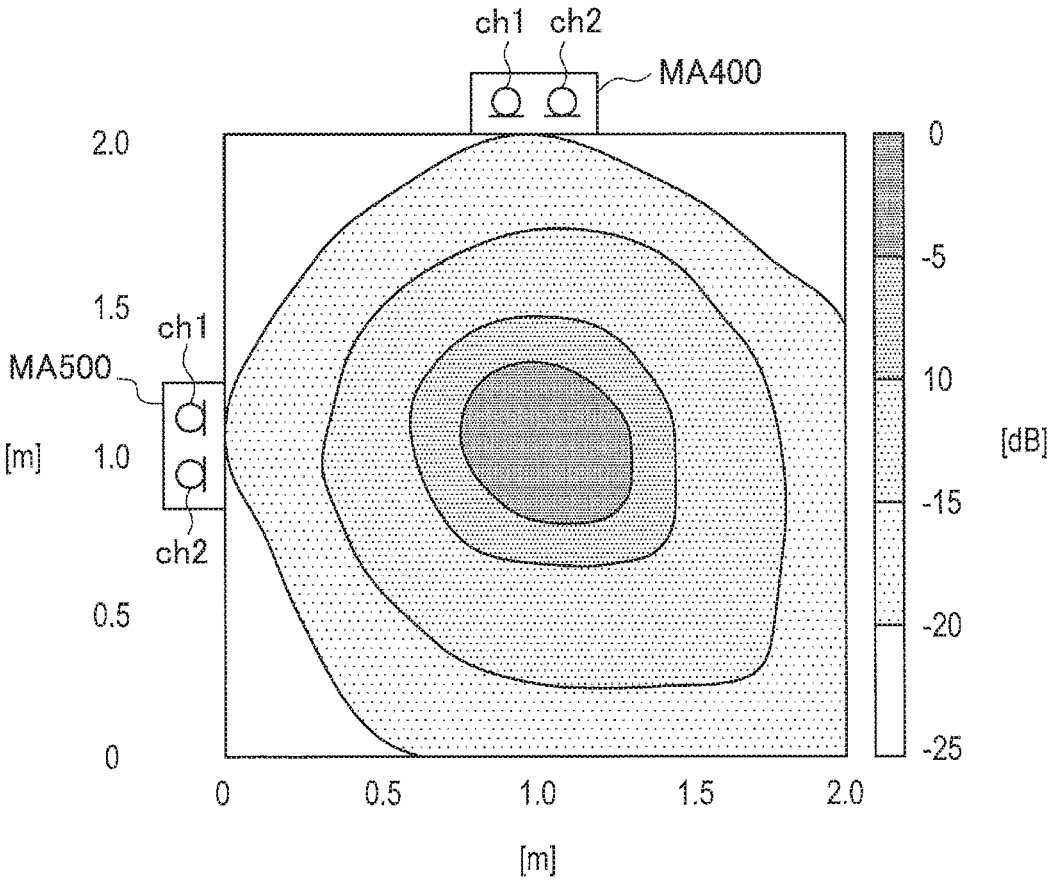
FIG. 6 is a diagram illustrating sensitivity distribution (calculated sensitivity distribution) of area sound pick-up in a case where directionalities of two microphone arrays are crossed.

FIG. 6 is a diagram illustrating the sensitivity distribution (calculated sensitivity distribution) of area sound pick-up in the case where the directionalities of two microphone arrays MA400 and MA500 are crossed at right angles. In other words, FIG. 6 illustrates the sensitivity of area sound pick-up in a region in which the directionalities of the two microphone arrays MA400 and MA500 are crossed and in the vicinity of the region. Note that, in FIG. 6, the microphone arrays MA400 and MA500 each include the two microphones ch1 and ch2. In addition, FIG. 6 classifies the sensitivity of area sound pick-up into five stages (0 to −5 dB, −5 to −10 dB, −10 to −15 dB, −15 to −20 dB, and −20 to −25 dB), and imparts a pattern (design) different for each stage. As illustrated in FIG. 6, it is understood that a region of high sensitivity extends more distant from the microphone arrays MA400 and MA500 (i.e., lower right direction).

Thus, sound pick-up areas for area sound pick-up (area sound pick-up sensitivity distribution) by a combination (combination of the microphone arrays MA301 and MA302) of FIG. 5A, a combination (combination of the microphone arrays MA302 and MA303) of FIG. 5B, and a combination (combination of the microphone arrays MA303 and MA301) of FIG. 5C are different for the respective combinations of microphone arrays, resulting in overlapping parts and non-overlapping parts (parts with the same sensitivity distribution and not the same sensitivity distribution).

That is, as illustrated in FIGS. 5A to 5C, in the configuration of the three microphones ch1 to ch3, if area sound pick-up is performed with two or three different combinations of microphone arrays and respective sound pick-up results are added, it is possible to perform area sound pick-up within a wider range than a sound pick-up area defined by one combination of microphone arrays. In other words, performing a process of performing area sound pick-up with a plurality of different combinations of microphone arrays (combination patterns) among a plurality of microphone arrays including microphones disposed at the positions of the respective vertices of a polygon (N-sided polygon; N represents an integer greater than or equal to three), and treating a result obtained by adding respective area sound pick-up results (outputs of area sound pick-up) as a final sound pick-up result of a target area makes it possible to perform more robust area sound pick-up (more stable area sound pick-up) with respect to a difference between the positions of the mouths of speakers (positions of the mouths of the speakers as viewed from the transmitter).

However, the addition of sound pick-up results of a plurality of areas having an overlapping area emphasizes the gain of the overlapping area more than that of a non-overlapping area because an area component is added. With respect to an extended area, the sound pick-up characteristic of the inside of the area becomes non-uniform as a result, and different from the original characteristic of a target sound source present in the area in some cases. Especially, in the case where the sound source is positioned between the overlapping area and the non-overlapping area, the characteristic is distorted in all likelihood.

Accordingly, it is assumed that the sound pick-up unit (sound pick-up apparatus) according to the first embodiment compares, for a plurality of area sound pick-up outputs having an overlapping area, the same frequency components of the respective outputs, and selects only an output of the area having the maximum amplitude as a component of a plurality of extended area sound pick-up outputs. Then, the sound pick-up unit (sound pick-up apparatus) according to the first embodiment performs the maximum value selection process on all the frequency components. Thus, the sound pick-up unit (sound pick-up apparatus) according to the first embodiment does not add the components of a plurality of areas, but consequently selects and outputs only one area sound pick-up output for the same frequency component, so that the uniformity of the sound pick-up characteristics is maintained.

This allows the sound pick-up unit (sound pick-up apparatus) according to the first embodiment to make the sound pick-up characteristics of the inside of an extended area uniform and provide a stable sound pick-up method with less distortion.

(A-1) Configuration According to First Embodiment

FIG. 1 is a block diagram illustrating the configuration of each apparatus related to this embodiment.

FIG. 1 illustrates a communication apparatus 100 including a sound pick-up unit 120 according to this embodiment, and a communication apparatus 200. In addition, FIG. 1 illustrates a configuration in which it is possible communicate between the communication apparatuses 100 and 200 via a communication path P. The sound pick-up unit 120 is configured to achieve the basic principle described above.

The communication apparatus 100 is an apparatus that picks up a voice (sound) spoken by a first user U1, transmits the voice data of the voice which is picked up to the communication apparatus 200 via the communication path P, and makes an output for a voice (voice spoken by a second user U2) based on voice data received from the communication apparatus 200. In addition, the communication apparatus 200 is an apparatus that picks up a voice (sound) spoken by the second user U2, transmits the voice data of the voice which is picked up to the communication apparatus 100 via the communication path P, and makes an output for a voice (voice spoken by the first user U1) based on voice data received from the communication apparatus 100.

Examples of the first user U1 include a crew and the like of an emergency vehicle such as an ambulance and a fire engine. Examples of the second user U2 include a commander and the like in a remote location (e.g., command center that leads an emergency vehicle).

The communication path P is not limited to a wired/wireless communication path, but a variety of connection means and connection configurations (network configurations) are applicable.

Next, the configuration overview of the communication apparatus 100 will be described by using FIG. 1.

The communication apparatus 100 includes a handset 110, the sound pick-up unit 120, a communication unit 130, and an output unit 140.

The handset 110 includes a microphone array unit 111 including three microphones MC1 to MC3 (3ch microphones) and a speaker 112.

The communication unit 130 is a communication interface for communicating with the communication apparatus 200 via the communication path P.

The sound pick-up unit 120 picks up a voice (sound) spoken by the first user U1 on the basis of an acoustic signal captured by the microphone array unit 111. Then, the communication unit 130 transmits the voice data of the voice that is picked up by the sound pick-up unit 120 to the communication apparatus 200 side.

The output unit 140 acquires voice data (voice data of a voice spoken by the second user U2) from the communication apparatus 200 via the communication unit 130, supplies an acoustic signal based on the voice data to the speaker 112, and causes the speaker 112 to make a phonetic output of the acoustic signal.

The hardware configuration of the communication apparatus 100 is not limited, but it is assumed in an example of this embodiment that, as illustrated in FIG. 1, the communication apparatus 100 is configured as a telephone including the handset 110 as hardware. Note that the communication apparatus 100 does not necessarily have to include the handset 110, but may also be configured like a smartphone such that the entire housing (chassis) substantially functions as a handset (e.g., configuration in which a mouthpiece is set at a part of the housing of the smartphone).

Next, the configuration overview of the communication apparatus 200 will be described by using FIG. 1.

The communication apparatus 200 includes a speaker 210, a microphone 220, a communication unit 230, an output unit 240, and a sound pick-up unit 250.

The communication unit 230 is a communication interface for communicating with the communication apparatus 200 via the communication path P.

The sound pick-up unit 250 picks up a voice (sound) spoken by the second user U2 on the basis of an acoustic signal captured by the microphone 220. Then, the communication unit 230 transmits the voice data of the voice that is picked up by the sound pick-up unit 250 to the communication apparatus 100 side.

The output unit 240 acquires voice data (voice data of a voice spoken by the first user U1) from the communication apparatus 100 via the communication unit 230, supplies an acoustic signal based on the voice data to the speaker 210, and causes the speaker 210 to make a phonetic output of the acoustic signal.

Next, the detailed configuration of the sound pick-up unit 120 will be described by using FIG. 1.

The sound pick-up unit 120 includes a signal input unit 121, a frequency transform unit 122, a directionality formation unit 123, a target area sound extraction unit 124, and an area sound component selection unit 125.

The sound pick-up unit 120 may cause, for example, a computer including a processor, a memory, and the like to execute a program (including a sound pick-up program according to an embodiment), but can function as illustrated in FIG. 1 even in that case. The details of the process of each component of the sound pick-up unit 120 will be described below.

Next, the configuration of the handset 110 serving as a transmitter and receiver will be described by using FIGS. 2 and 3.

Figure 2:
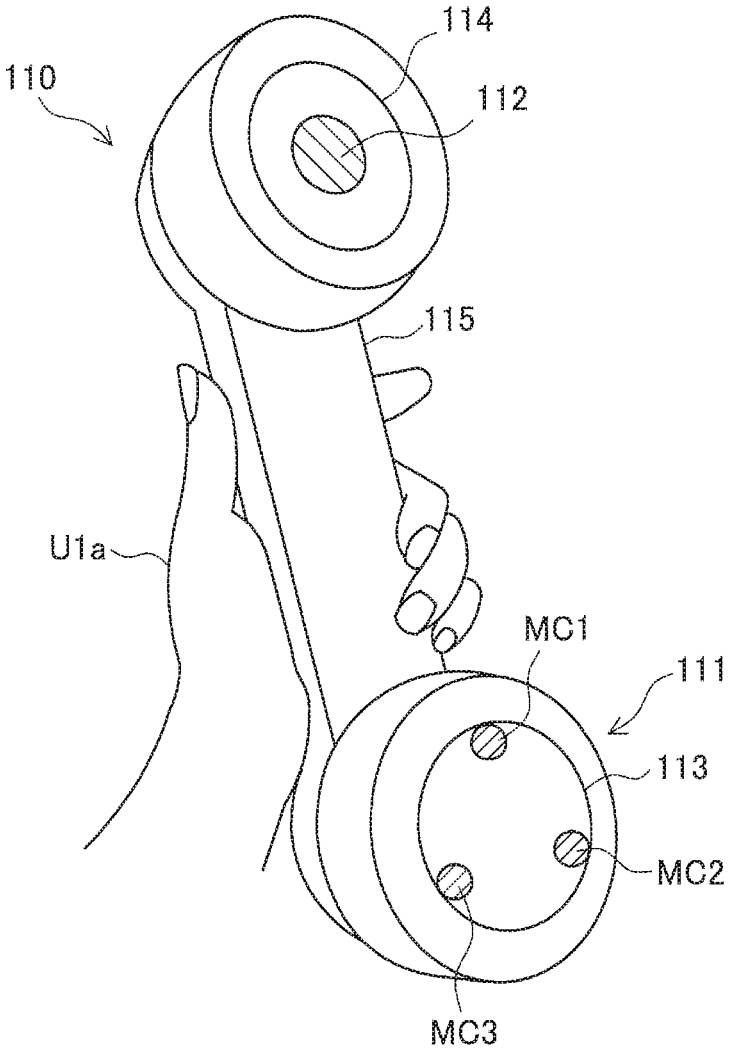
FIG. 2 is a diagram (perspective view) illustrating a use state of a handset according to the first embodiment.

FIG. 2 is a perspective view illustrating that the handset 110 is grasped with a hand U1*a* of the first user U1.

As illustrated in FIG. 2, the handset 110 includes a stick-shaped grip unit 115 for causing the first user U1 (hand U1*a*) to grip, a mouthpiece 113 (transmitter) provided to an end of the grip unit 115, and an earpiece 114 (receiver) provided to the other end of the grip unit 115.

Figure 3:
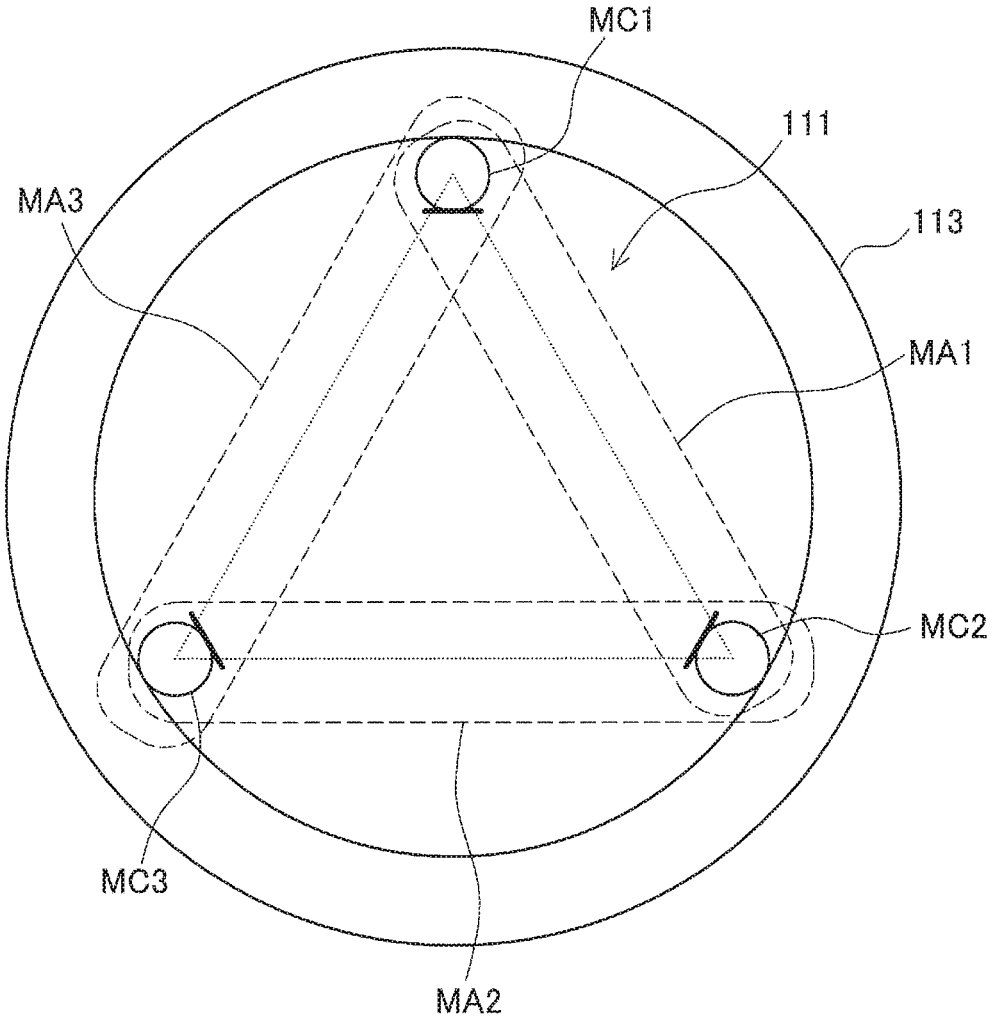
FIG. 3 is a diagram illustrating a magnified mouthpiece part of the handset according to the first embodiment.

FIG. 3 is a diagram illustrating the magnified mouthpiece 113 part of the handset 110.

As illustrated in FIG. 2, the speaker 112 is disposed at the earpiece 114. In addition, as illustrated in FIGS. 2 and 3, the microphone array unit 111 (microphones MC1 to MC3) is disposed at the mouthpiece 113 having a circular surface.

Next, the configuration of the microphone array unit 111 will be described by using FIGS. 2 and 3.

In an example of this embodiment, it is assumed that the microphone array unit 111 includes the three microphones MC1 to MC3.

As illustrated in FIG. 2, in the case where the first user U1 grasps the communication apparatus 100 with the hand U1*a* and pushes a speaker SP to an ear, the three microphones MC1 to MC3 are disposed around the mouthpiece 113 (around the part that is the closest to the mouth of the first user U1) at which the mouth of the first user U1 is positioned.

Similarly to the configurations illustrated in FIGS. 4 and 5A to 5C described above, the respect positions (central positions of the respective microphones) of the three microphones MC1 to MC3 included in the microphone array unit 111 are disposed to serve as the vertices of a regular triangle on and around the mouthpiece 113 in the handset 110 illustrated in FIGS. 2 and 3. In FIGS. 2 and 3, to isotropically expand the sound pick-up areas, the respective sides of a triangle made by the microphones MC1 to MC3 have the same distance (a triangle made by the microphones MC1 to MC3 is a regular triangle), but the respective sides do not all have to have the same distance or the respective vertices do not all have to have the same angles.

Note that, as illustrated in FIG. 3, the following refers to a microphone array having the microphones MC1 and MC2 as a pair as MA1, a microphone array having the microphones MC2 and MC3 as a pair as MA2, and a microphone array having the microphones MC3 and MC1 as a pair as MA3 in the microphone array unit 111.

(A-2) Operation According to First Embodiment

Next, an operation (sound pick-up method according to an embodiment) according to this embodiment including a configuration as described above will be described.

The sound pick-up unit 120 of the communication apparatus 100 uses acoustic signals supplied from the microphones MC1 to MC3 of the microphone array unit 111 to perform a target area sound pick-up process of picking up a target area sound in a target area.

The following chiefly describes the operation of the inside of the sound pick-up unit 120 included in the communication apparatus 100.

The signal input unit 121 converts acoustic signals that are picked up by the respective microphones MC1 to MC3 from analog signals to digital signals, and supplies the converted signals to the frequency transform unit 122. Afterward, the frequency transform unit 122 uses, for example, fast Fourier transform to transform microphone signals from the time domain to the frequency domain. The directionality formation unit 123 forms a directionality with a BF.

Figure 7:
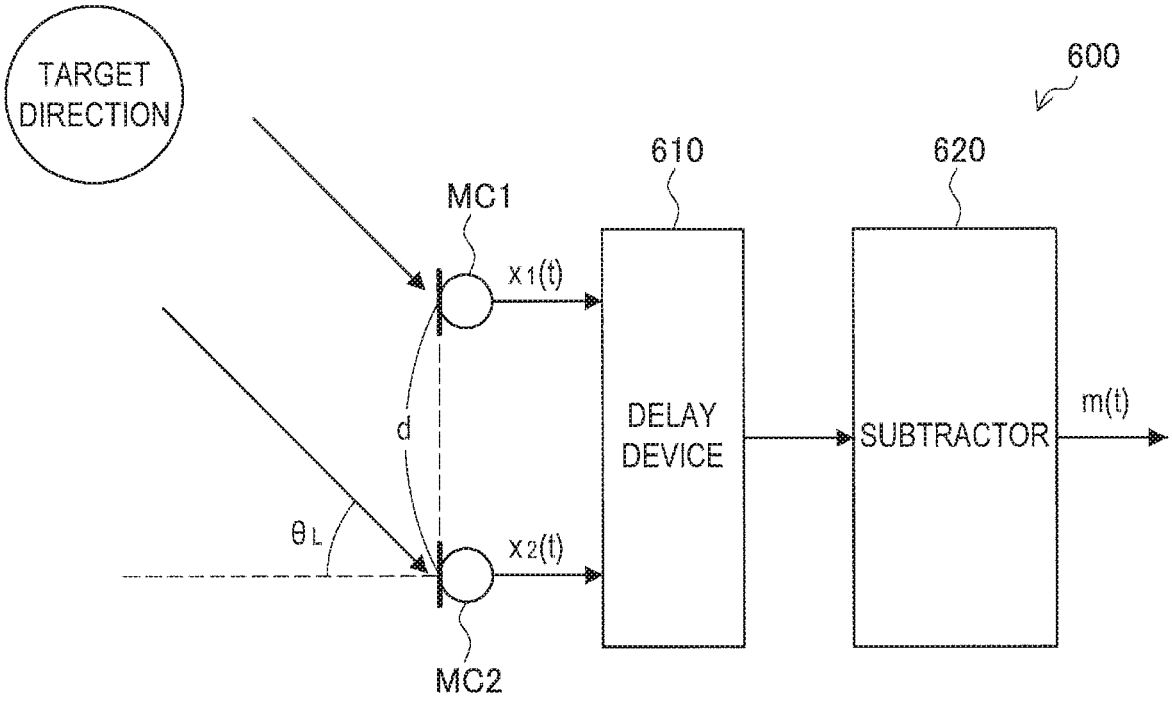
FIG. 7 is a block diagram illustrating a configuration of a subtraction-type BF in a case where a number of microphones is two.
Figure 8A:
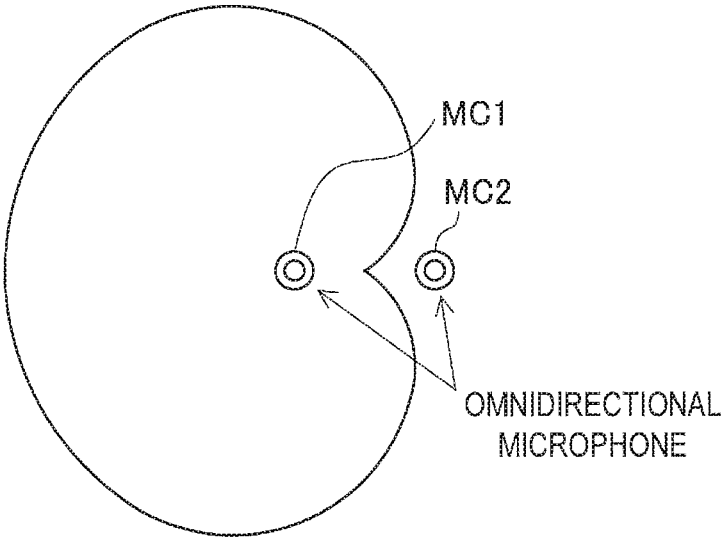
FIG. 8A is a (first) diagram illustrating a directionality characteristic formed by a subtraction-type BF that uses two microphones.
Figure 8B:
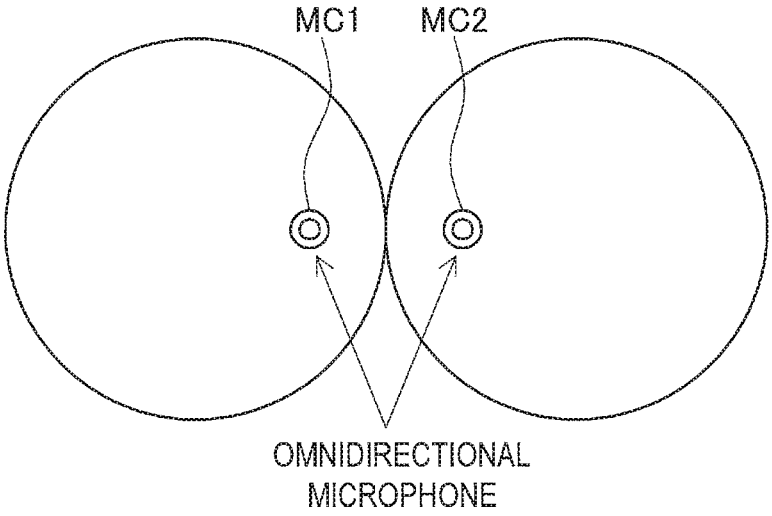
FIG. 8B is a (second) diagram illustrating a directionality characteristic formed by a subtraction-type BF that uses two microphones.

Here, FIGS. 7, 8A, and 8B are used to describe directionality formation with a BF.

The BF is technology of using a time lag between signals arriving at the respective microphones in the microphone array to forming a directionality for sound pick-up (see non-Patent Literature 1 (Futoshi Asano (Author), "Sound technology series 16: Array signal processing for acoustics: localization, tracking and separation of sound sources", The Acoustical Society of Japan Edition, Corona publishing Co. Ltd, publication date: Feb. 25, 2011)). The BF roughly comes in two types: addition-type; and subtraction-type. However, a subtraction-type BF will be described here that can form a directionality with a smaller number of microphones.

FIG. 7 is a block diagram illustrating the configuration of a subtraction-type BF 600 in the case where the number of microphones is two (MC1 and MC2).

FIGS. 8A and 8B are diagrams each illustrating a directionality characteristic formed by the subtraction-type BF 600 that uses the two microphones MC1 and MC2.

The subtraction-type BF600 first uses a delay device 610 to calculate a signal time lag generated when sounds (which will be referred to as "target sounds" below) present in a target direction arrive at the respective microphones MC1 and MC2, and adds a delay to obtain target sounds in phase. The time lag is calculated in accordance with an expression (1). Here, d represents the distance between the microphones MC1 and MC2, c represents the speed of sound, and $\tau_i$ represents a delay amount. In addition, $\theta_L$ represents the angle from the vertical direction to the target direction with respect to the straight line connecting the positions of the microphones MC1 and MC2.

Here, when a dead angle is present in the direction of the microphone MC1, with respect to the center of the microphone MC1 and the microphone MC2, the delay device 610 performs a delay process on an input signal $x_1(t)$ of the microphone MC1. Afterwards, the subtractor 620 performs a subtraction process in accordance with an expression (2). The subtractor 620 can similarly perform this subtraction process in the frequency domain. In that case, the expression (2) is changed like an expression (3).

$$\tau_L=(d \sin \theta_L)/c \tag{1}$$

$$m(t)=x_2(t)-x_1(t-\tau_L) \tag{2}$$

$$M(\omega)=X_2(\omega)-e^{-j\omega\tau_L}X_1(\omega) \tag{3}$$

Here, in the case of $\theta_L=\pm\pi/2$, a directionality to be formed is a cardioid unidirectionality as illustrated in FIG. 8A, and in the case of $\theta_L=0$ or $\pi$, a directionality to be formed is an 8-shaped bidirectionality as illustrated in FIG. 8B. In addition, the subtractor 620 can also form directionality that is strong in a dead angle of bidirectionality by using a spectral subtraction process (which will also be referred to simply as "SS" below). The directionality by using an SS is formed in all the frequency bands or a designated frequency band in accordance with an expression (4). The expression (4) uses an input signal $X_1$ of the microphone MC1, but it is also possible to attain the similar advantageous effects by using an input signal $X_2$ of the microphone MC2. Here, n represents a frame number, and $\beta$ represents a coefficient for adjusting the strength of an SS. In the case where subtraction yields a negative value, the subtractor 620 may perform a flooring process of replacing the negative value with zero or a value obtained by reducing the original value. By extracting sounds other than those in a target direction (which will be referred to as "non-target sounds" below) by the bidirectional characteristics, and subtracting the amplitude spectra of the extracted non-target sounds from the amplitude spectrum of the input signal, this scheme can emphasize target sounds.

$$Y(n)=X_1(n)-\beta M(n) \tag{4}$$

Incidentally, in the case where it is desirable to pick up only a target area sound present in a certain specific target area, the use of a subtraction-type BF alone causes a sound (which will be referred to as "non-target area sound" below) present in the same direction as that of the area to be picked up.

Then, it is assumed that the directionality formation unit 123 performs the area sound pick-up process (process of using a plurality of microphone arrays to point the directionalities to a target area from different directions, and crossing the directionalities in the target area to pick up target area sounds) proposed in Patent Literature 1. Specifically, the directionality formation unit 123 may also use the following process to perform the area sound pick-up process.

The directionality formation unit 123 uses a BF to form a directionality toward the inside of a triangle (triangle formed by the microphones MC1 to MC3) for each of the microphone arrays MA1 to MA3. Then, the directionality formation unit 123 supplies respective BF outputs $Y_1(n)$, $Y_2(n)$, and $Y_3(n)$ of the microphone arrays MA1, MA2, and MA3 to the target area sound extraction unit 124.

The target area sound extraction unit 124 extracts area sounds using the BF outputs $Y_1(n)$, $Y_2(n)$, and $Y_3(n)$. As described above, the respective BF outputs ($Y_1(n)$, $Y_2(n)$, and $Y_3(n)$) have directionalities from the respective sides of the triangle (triangle formed by the microphones MC1 to MC3) to the center (direction toward the inside of the triangle). Thus, the respective BF outputs have two directionalities crossed near the center of the triangle in any two combinations (combination patterns), so that the target area sound extraction unit 124 can extract a sound in an area in which the directionalities thereof are crossed in an area sound pick-up method described below. Here, as a representative, the case will be described where the BF output $Y_1(n)$ of the microphone array MA1 and the BF output $Y_2(n)$ of the microphone array MA2 are used. The target area sound extraction unit 124 performs an SS on $Y_1(n)$ and $Y_2(n)$ in accordance with an expression (5) or (6), and extracts non-target area sounds $N_{1\text{-}1}(n)$ and $N_{1\text{-}2}(n)$ present in a target area direction. Here, $\alpha_1$ and $\alpha_2$ are correction coefficients for correcting a signal level difference caused by a distance difference between a target area and the respective microphone arrays, and should be sequentially calculated in accordance with a predetermined process, and a technique thereof is also described in Patent Literature 1, but it is assumed here for the sake of simplicity that the distance to the target area and the distance to each microphone array are the same ($\alpha_1(n)=\alpha_2(n)=1$) and the expressions (5) and (6) are transformed to expressions (7) and (8).

$$N_{1\text{-}1}(n)=Y_1(n)-\alpha_2(n)Y_2(n) \tag{5}$$

$$N_{1\text{-}2}(n)=Y_2(n)-\alpha_1(n)Y_1(n) \tag{6}$$

$$N_{1\text{-}1}(n)=Y_1(n)-Y_2(n) \tag{7}$$

$$N_{1\text{-}2}(n)=Y_2(n)-Y_1(n) \tag{8}$$

Afterward, the target area sound extraction unit 124 performs an SS on non-target area sounds from the respective BF outputs in accordance with expressions (9) and (10) to extract target area sounds. Here, $\gamma_1(n)$ and $\gamma_2(n)$ are coefficients for changing the strength at the time of the SS.

$$Z_{1\text{-}1}(n)=Y_1(n)-\gamma_1(n)N_{1\text{-}1}(n) \tag{9}$$

$$Z_{1\text{-}2}(n)=Y_2(n)-\gamma_2(n)N_{1\text{-}2}(n) \tag{10}$$

In the target area sound extraction unit 124, any of emphasized sounds $Z_{1\text{-}1}(n)$ and $Z_{1\text{-}2}(n)$ may be used as an output, but it is assumed here that $Z_{1\text{-}1}(n)$ is used as an area sound pick-up output $Z_1(n)$ of the combination of the microphone array MA1 and the microphone array MA2 (combination pattern).

Similarly, the target area sound extraction unit 124 extracts an area sound pick-up output $Z_2(n)$ of the combination of the microphone array MA2 and the microphone array MA3 and an area sound pick-up output $Z_3(n)$ of the combination of the microphone array MA3 and the microphone array MA1, and supplies the area sound component selection unit 125 therewith.

The following refers to the sound pick-up area (area corresponding to the area A301 of FIG. 5A described above) of the combination of the microphone array MA1 and the microphone array MA2 as area A1, the sound pick-up area (area corresponding to the area A302 of FIG. 5B described above) of the combination of the microphone array MA2 and the microphone array MA3 as area A2, and the sound pick-up area (area corresponding to the area A303 of FIG. 5C described above) of the combination of the microphone array MA3 and the microphone array MA1 as area A3.

The areas A1, A2, and A3 each have an overlapping area, but are different from each other as a whole. Accordingly, the respective area sound pick-up outputs $Z_1(n)$, $Z_2(n)$, and $Z_3(n)$ have different frequency components (features). The area sound component selection unit 125 selects a component with the maximum amplitude on the basis of a result obtained by comparing the same frequency components of the respective area sound pick-up outputs, and extracts the maximum amplitude component as the components of outputs of extended multiple-area sound pick-up.

Figure 9:
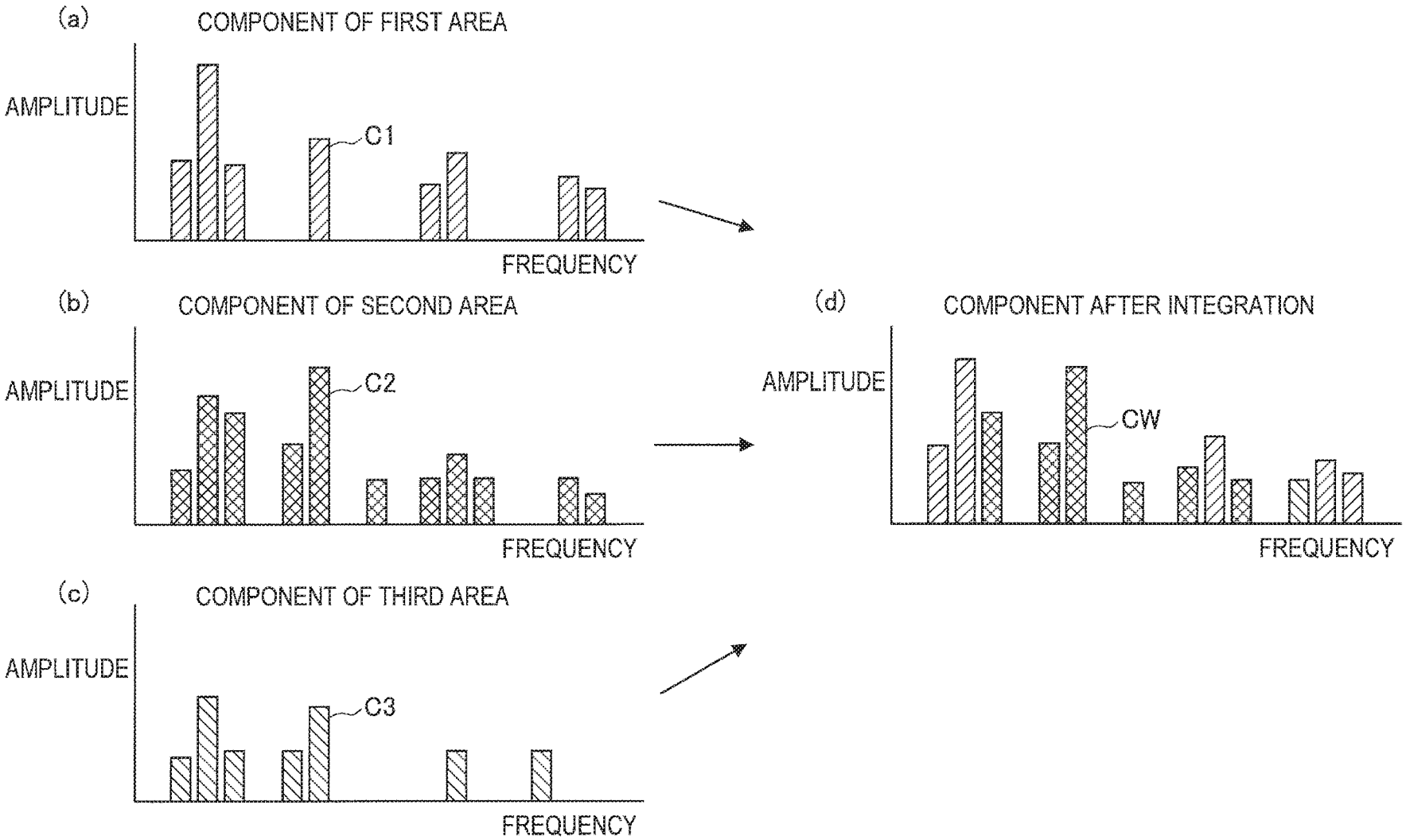
FIG. 9 is an explanatory diagram (image diagram) illustrating a process of integrating area sound pick-up results in the sound pick-up unit (sound pick-up apparatus) according to the first embodiment.

FIG. 9 is an explanatory diagram (image diagram) schematically illustrating a process that is performed by the area sound component selection unit 125. FIGS. 9(*a*), 9(*b*), and 9(*c*) are diagrams respectively illustrating the area sound components (amplitude for each frequency) of $Z_1(n)$, $Z_2(n)$, and $Z_3(n)$ in the form of bar graphs. Then, FIG. 9(*d*) is a diagram illustrating the component (amplitude for each frequency) of a final output W(n) that is a result obtained by integrating the area sound pick-up outputs $Z_1(n)$, $Z_2(n)$, and $Z_3(n)$ in the form of a bar graph.

FIG. 9 illustrates the component of the area sound pick-up output $Z_1(n)$ at any frequency m as "C1" ($C1=Z_1(m)$), the component of the area sound pick-up output $Z_2(n)$ at the frequency m as "C2" ($C2=Z_2(m)$), the component of the area sound pick-up output $Z_3(n)$ at the frequency m as "C3" ($C3=Z_3(m)$), and the amplitude of the final output W(n) at the frequency m as "CW" (CW=W(m)).

The area sound component selection unit 125 selects the component (component with the maximum amplitude) with the greatest strength from C1, C2, and C3, and applies it to CW (final output W(m)). In FIG. 9, C2 is selected from C1, C2, and C3 as the component (component with the maximum amplitude) with the greatest strength, and applied to CW. The area sound component selection unit 125 performs a similar process on all the frequencies (all the components) to generate the final output W(n).

As described above, the sound pick-up unit 120 outputs the final output W(n) as a target voice that is picked up from an expanded area. At this time, the sound pick-up unit 120 may output W(n) as voice data obtained by performing frequency-time transform.

Then, the communication unit 130 transmits the voice data based on the final output W(n) to the communication apparatus 200 via the communication path P.

Then, the communication unit 230 of the communication apparatus 200 supplies the voice data (voice data based on W(n)) received from the communication apparatus 100 to the output unit 140. The output unit 140 supplies an acoustic signal based on the received voice data to the speaker 210, and causes the speaker 210 to make a phonetic output (phonetic output toward the second user U2).

(A-3) Advantageous Effects of First Embodiment

According to the first embodiment, the following advantageous effects can be attained.

The sound pick-up unit 120 according to the first embodiment performs area sound pick-up from different directions, and can form an isotropic sound pick-up area that is wider as compared with conventional area sound pick-up which uses one pair of microphone arrays. The sound pick-up unit 120 according to the first embodiment selects and outputs only one area sound pick-up output for the same frequency component in the frequency components of a plurality of area sound pick-up outputs, so that the uniformity of sound pick-up characteristics is maintained even in an expanded area. This enables the sound pick-up unit 120 to stably pick up a voice even in the case where the relative positions of the mouth of a speaker (first user U1) and the mouthpiece 113 are out of alignment or the like when area sound pick-up that uses the microphones MC1 to MC3 attached to the mouthpiece 113 of the handset 110 is performed.

(B) Second Embodiment

The following describes a sound pick-up apparatus, program (medium), and method according to a second embodiment of the present invention in detail with reference to the drawings. In this embodiment, an example will be described in which the sound pick-up apparatus, program (medium), and method according to the second embodiment of the present invention are applied to a sound pick-up unit.

The sound pick-up unit (sound pick-up apparatus) according to the second embodiment is different from that of the first embodiment in that the sound pick-up unit (sound pick-up apparatus) according to the second embodiment calculates the power of area sound pick-up outputs of multiple-area sound pick-up, regards the area sound pick-up output with the maximum power as an output of an extended area, and causes it to be selected and represent. That is, different from the first embodiment, the sound pick-up unit (sound pick-up apparatus) according to the second embodiment does not detect the maximum value for each frequency component, but selects the area with the maximum power.

(B-1) Configuration According to Second Embodiment

Figure 10:
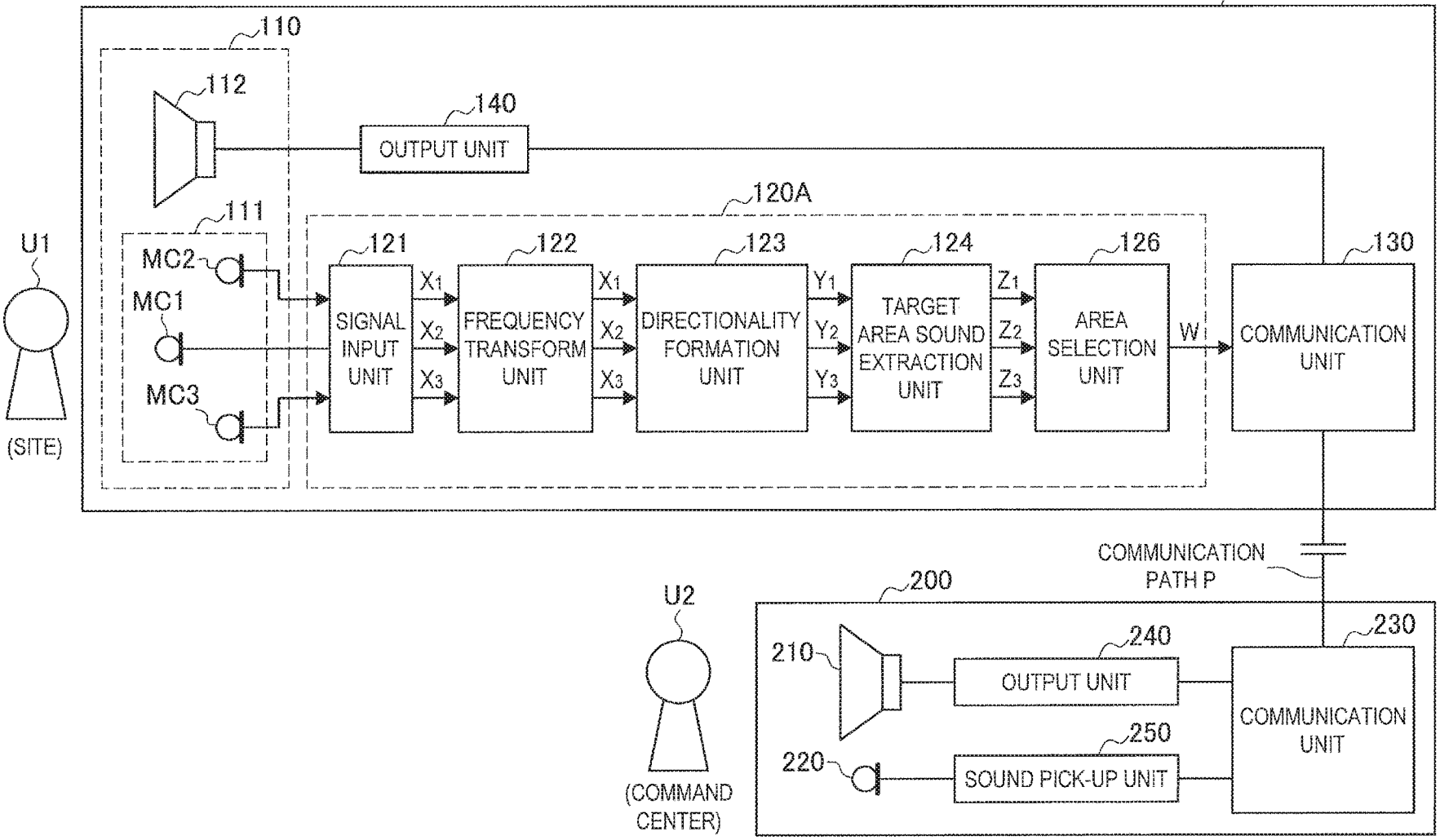
FIG. 10 is a block diagram illustrating a configuration (including a functional configuration of a sound pick-up unit (sound pick-up apparatus) according to a second embodiment) of each apparatus according to the second embodiment.

FIG. 10 is a block diagram illustrating the configuration of each apparatus related to the second embodiment.

The second embodiment is different from the first embodiment in that the communication apparatus 100 is replaced with a communication apparatus 100A.

In addition, it is different from the first embodiment in that the sound pick-up unit 120 is replaced with a sound pick-up unit 120A in the communication apparatus 100A according to the second embodiment. Moreover, it is different from the first embodiment in that the target area sound extraction unit 124 and the area sound component selection unit 125 are removed from the sound pick-up unit 120A according to the second embodiment, and an area selection unit 126 is added to the sound pick-up unit 120A according to the second embodiment.

(B-2) Operation According to Second Embodiment

Next, an operation (sound pick-up method according to an embodiment) according to the first embodiment including a configuration as described above will be described.

The following describes a difference from the first embodiment with respect to the operation the inside of the sound pick-up unit 120A included in the communication apparatus 100A.

In the sound pick-up unit 120A, the processes from the microphone array unit 111 to the target area sound extraction unit 124 are similar to the processes of the first embodiment. In the second embodiment, instead of "size comparison between the same frequency components of a plurality of area sounds" in the first embodiment, the power of a plurality of area sound pick-up outputs is calculated, and the area sound pick-up output having the greatest power is regarded as an output of an extended area and caused to be selected and represent.

The area selection unit 126 calculates the power (e.g., additional value of each frequency component or average value of the respective frequency components) of each of the area sound pick-up outputs $Z_1(n)$, $Z_2(n)$, and $Z_3(n)$ extracted by an area sound extraction unit, and acquires the output with the greatest power among the three outputs as the final output W(n).

W(n) is output from the communication apparatus 200 (speaker 210) via a communication path after time transform.

(B-3) Advantageous Effects of Second Embodiment

According to the second embodiment, it is possible to attain the following advantageous effects as compared with the first embodiment.

The sound pick-up unit 120A according to the second embodiment selects and outputs the area sound pick-up output (i.e., area sound pick-up output of the area including the most target sounds) with the greatest power from the plurality of area sound pick-up outputs, so that it is possible to approximately expand a sound pick-up area, and the uniformity of sound pick-up characteristics is maintained because only one area sound (area sound pick-up output) is selected and output.

(C) Third Embodiment

The following describes a sound pick-up apparatus, program (medium), and method according to a third embodiment of the present invention in detail with reference to the drawings. In this embodiment, an example will be described in which the sound pick-up apparatus, program (medium), and method according to the third embodiment of the present invention are applied to a sound pick-up unit.

It is different from the first embodiment in that the sound pick-up unit (sound pick-up apparatus) according to the third embodiment determines for a plurality of areas whether or not each area has a target area sound, and regards only an area sound pick-up output for which it is determined that a target sound is present as a target of a frequency component maximum value selection process (e.g., process of the area sound component selection unit 125 in the first embodiment).

(C-1) Configuration According to Third Embodiment

Figure 11:
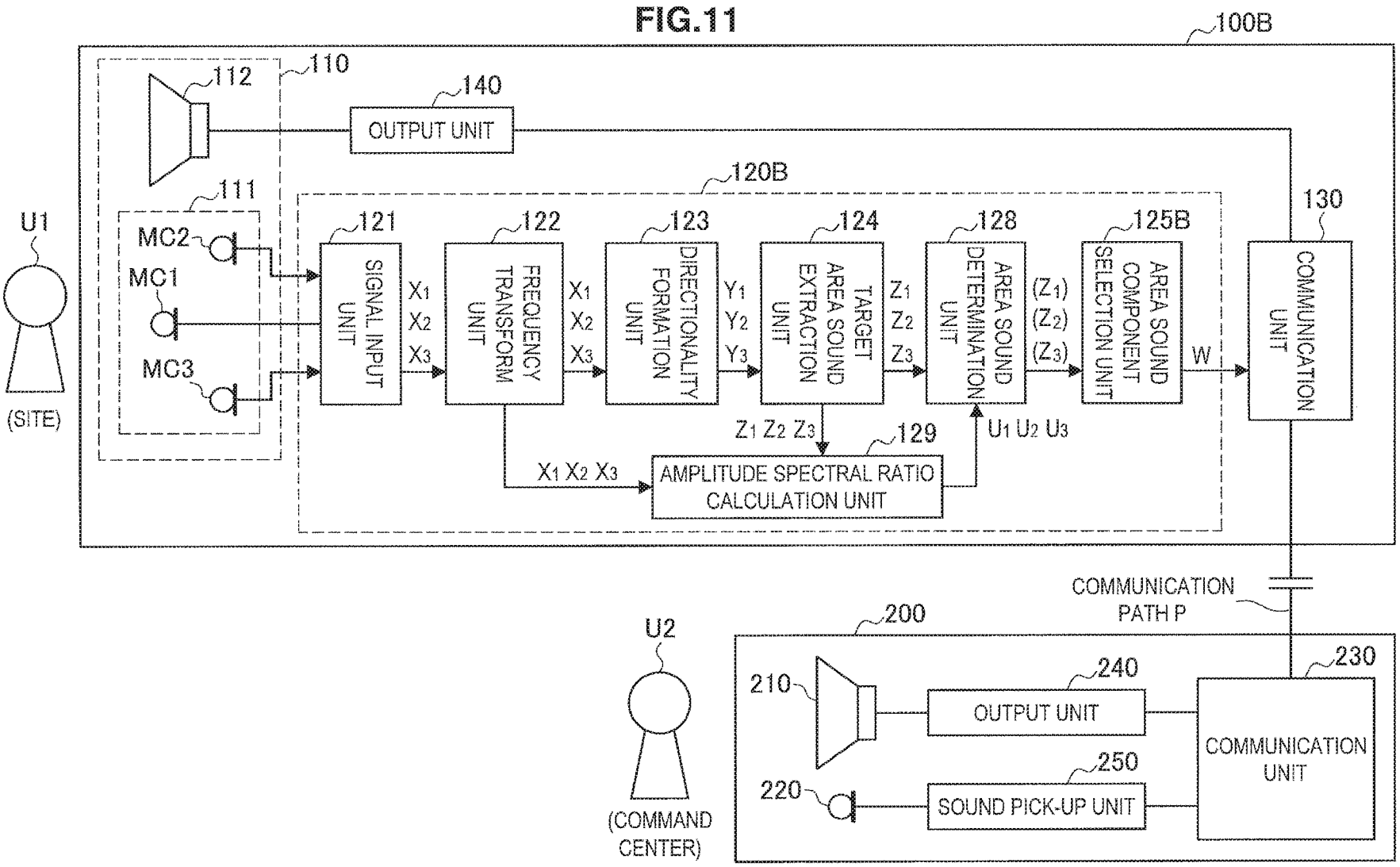
FIG. 11 is a block diagram illustrating a configuration (including a functional configuration of a sound pick-up unit (sound pick-up apparatus) according to a third embodiment) of each apparatus according to the third embodiment.

FIG. 11 is a block diagram illustrating the configuration of each apparatus related to the third embodiment.

The third embodiment is different from the first embodiment in that the communication apparatus 100 is replaced with a communication apparatus 100B. In addition, the third embodiment is different from the first embodiment in that the sound pick-up unit 120 is replaced with a sound pick-up unit 120B.

It is different from the first embodiment in that the area sound component selection unit 125 is replaced with an area sound component selection unit 125B in the sound pick-up unit 120B according to the third embodiment, and an area sound determination unit 128 and an amplitude spectral ratio calculation unit 129 are added to the sound pick-up unit 120B according to the third embodiment.

The sound pick-up unit 120 according to the first embodiment acquires area sound pick-up outputs for a plurality of sound pick-up areas, and integrates all the acquired area sound pick-up outputs to expand a sound pick-up area, but it is not meant that all the acquired area sound pick-up outputs include target sound components. The sound pick-up unit 120 according to the first embodiment can acquire area sound pick-up outputs of a plurality of sound pick-up areas, but some of the plurality of area sound pick-up outputs can include no target sound components.

Thus, it is not advantageous in some cases that the frequency component of an area sound pick-up output including no target sound component is also subjected to maximum component detection. For example, in the case where an area sound pick-up output including no target sound is added to selection in the sound pick-up unit 120 according to the first embodiment, it can rather facilitate a noise component to increase. Then, the area sound determination unit 128 of the sound pick-up unit 120B determines for the respective area sound pick-up outputs ($Z_1(n)$, $Z_2(n)$, and $Z_3(n)$ in this embodiment) whether or not target area sounds are present. It is then assumed that the sound pick-up unit 120B according to the third embodiment treats only an area sound pick-up output for which it is determined by the area sound determination unit 128 that a target area sound is present as a target of component maximum value selection by the area sound component selection unit 125B.

(C-2) Operation According to Third Embodiment

Next, an operation (sound pick-up method according to an embodiment) according to the third embodiment including a configuration as described above will be described.

The following describes a difference from the first embodiment with respect to the operation the inside of the sound pick-up unit 120B included in the communication apparatus 100B.

In the sound pick-up unit 120B, the processes from the microphone array unit 111 to the target area sound extraction unit 124 are similar to the processes of the first embodiment.

The area sound determination unit 128 determines for each of the area sound pick-up outputs $Z_1(n)$, $Z_2(n)$, and $Z_3(n)$ acquired by the target area sound extraction unit 124 whether or not a target area sound is present.

A method for the area sound determination unit 128 to determine for each area sound pick-up output whether or not a target area sound is present is not limited. Examples thereof include a method for making a determination by using the amplitude spectral ratio between an area sound pick-up output and an input sound, a method for making a determination by using the coherence between BF outputs in performing area sound pick-up, and the like. In an example of this embodiment, it is assumed that the area sound determination unit 128 determines on the basis of the amplitude spectral ratios of the respective area sound pick-up outputs whether or not a target area sound is present. As a specific process of determining on the basis of the amplitude spectral ratio of area sound pick-up outputs in the area sound determination unit 128 whether or not a target area sound is present, for example, the process described in a reference literature 1 (JP 2016-127457A) is applicable.

The amplitude spectral ratio calculation unit 129 acquires input signals $X_1$, $X_2$, and $X_3$ subjected to frequency transform from the frequency transform unit 122, and area sound pick-up outputs $Z_1$, $Z_2$, and $Z_3$ from the target area sound extraction unit 124 to calculate an amplitude spectral ratio. For example, the amplitude spectral ratio calculation unit 129 uses the following expressions (11), (12), and (13) to calculate the amplitude spectral ratio between the area sound pick-up outputs $Z_1$, $Z_2$ and $Z_3$, and the input signals $X_1$, $X_2$ and $X_3$ for each frequency. Then, the amplitude spectral ratio calculation unit 129 uses the following (14), (15), and (16) to add the amplitude spectral ratios of all the frequencies and obtain amplitude spectral ratio additional values $U_1$, $U_2$, and $U_3$. Here, the area sound pick-up outputs $Z_1$, $Z_2$, and $Z_3$ are area sound pick-up outputs respectively obtained from the combinations of (microphone array MA1 and microphone array MA2), (microphone array MA2 and microphone array MA3), and (microphone array MA3 and microphone array MA1). Accordingly, $X_2$, $X_3$, and $X_1$ corresponding to the amplitude spectra of the component microphones MC2, MC3, and MC1 of the respective microphone arrays are used in the expressions (11), (12), and (13).

Note that $U_1$ obtained in the process performed by using the expression (14) is an amplitude spectral ratio additional value obtained by adding amplitude spectral ratios $R_{1i}$ of the respective frequencies in a band from a lower limit j to an upper limit k of the frequencies. In addition, $U_2$ obtained in the process performed by using the expression (15) is an amplitude spectral ratio additional value obtained by adding amplitude spectral ratios $R_{2i}$ of the respective frequencies in a band from a lower limit j to an upper limit k of the frequencies. Further, $U_3$ obtained in the process performed by using the expression (16) is an amplitude spectral ratio additional value obtained by adding amplitude spectral ratios $R_{3i}$ of the respective frequencies in a band from a lower limit j to an upper limit k of the frequencies. Here, a band of a frequency to be calculated by the amplitude spectral ratio calculation unit 129 may be limited. For example, the amplitude spectral ratio calculation unit 129 may limit a calculation target to 100 Hz to 6 kHz, in which voice information is sufficiently included and perform the calculation described above.

$$R_1 = \frac{X_2}{Z_1} \tag{11}$$

$$R_2 = \frac{X_3}{Z_2} \tag{12}$$

$$R_3 = \frac{X_1}{Z_3} \tag{13}$$

$$U_1 = \frac{1}{k-j}\sum_{i=j}^{k} R_{1_i} \tag{14}$$

$$U_2 = \frac{1}{k-j}\sum_{i=j}^{k} R_{2_i} \tag{15}$$

$$U_3 = \frac{1}{k-j}\sum_{i=j}^{k} R_{3_i} \tag{16}$$

The area sound determination unit 128 compares the amplitude spectral ratio additional value calculated by the amplitude spectral ratio calculation unit 129 with a threshold set in advance, and determines whether or not an area sound is present. The area sound determination unit 128 outputs, with no change, an area sound pick-up output for which it is determined that a target area sound is present, but refrains from outputting an area sound pick-up output for which it is determined that no target area sound is present and replaces it with silence data (e.g., dummy data set in advance) for output. Note that the area sound determination unit 128 may output the weakened gain of an input signal (input signal of any of microphones included in a microphone array used for area sound pick-up) instead of silence data. Moreover, in the case where the amplitude spectral ratio additional value is greater than the threshold at a particular level or higher, the area sound determination unit 128 may add a process (process corresponding to a hangover function) of determining that a target area sound is present irrespective of the amplitude spectral ratio additional value for the following several seconds.

The area sound component selection unit 125B compares the same frequency components of the respective area sound pick-up outputs which are sent from the area sound determination unit 128, selects a component with the maximum amplitude, and extracts the maximum amplitude component as the components of outputs of extended multiple-area sound pick-up. An area sound pick-up output for which it is determined by the area sound determination unit 128 that no target area sound is present has its gain weakened to zero or weakened considerably, so that it is seldom selected by the area sound component selection unit 125B.

Figure 12:
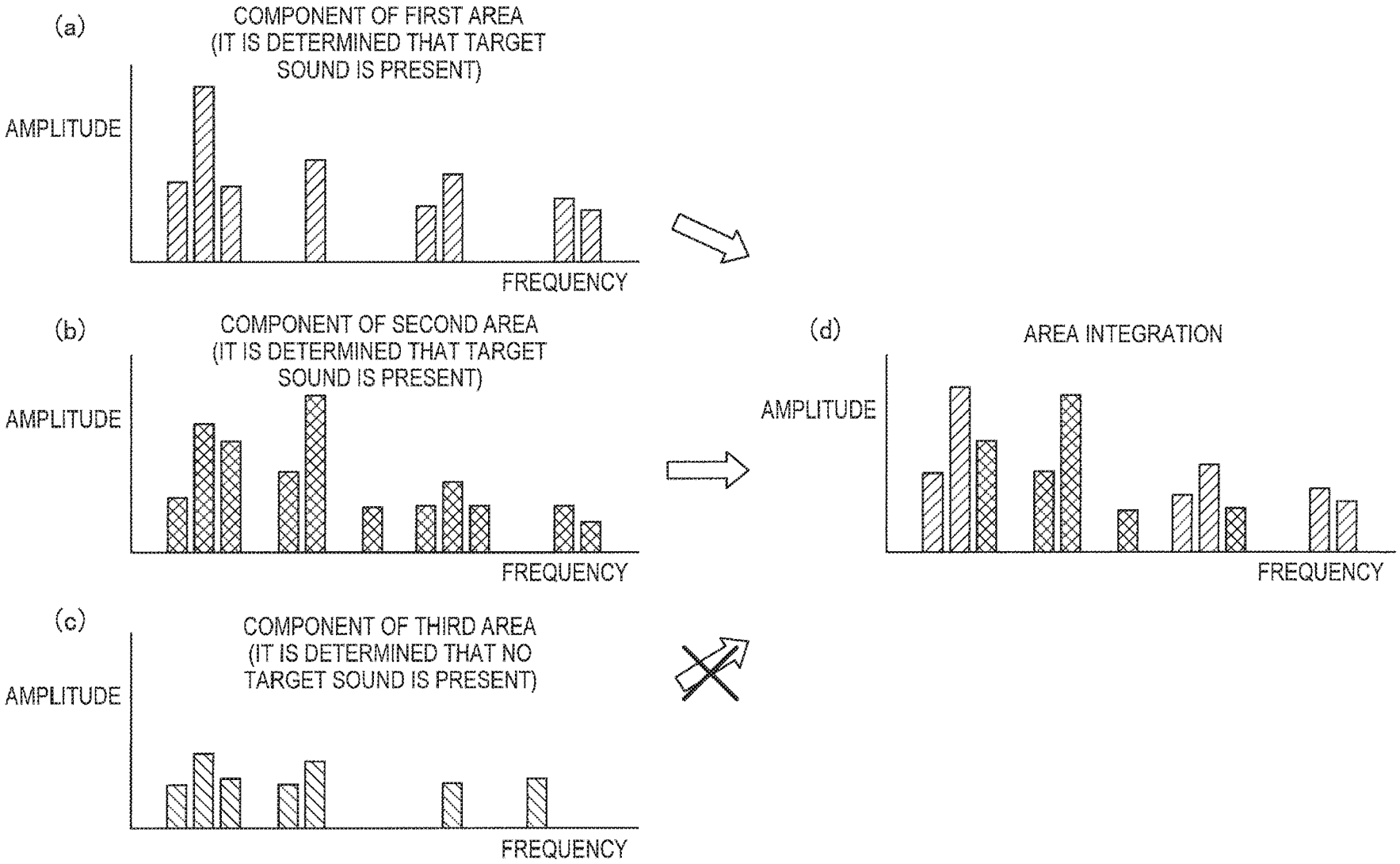
FIG. 12 is an explanatory diagram (image diagram) illustrating a process of integrating area sound pick-up results in the sound pick-up unit (sound pick-up apparatus) according to the third embodiment.

FIG. 12 is an explanatory diagram (image diagram) schematically illustrating a process that is performed by the area sound component selection unit 125B. FIGS. 12(*a*), 12(*b*), and 12(*c*) are diagrams respectively illustrating the area sound components (amplitude for each frequency) of $Z_1(n)$, $Z_2(n)$, and $Z_3(n)$ in the form of bar graphs. Then, FIG. 12(*d*) is a diagram illustrating the component (amplitude for each frequency) of the final output W(n) in the form of a bar graph.

In the example of FIG. 12, an example is shown in which the area sound determination unit 128 determines for the area sound pick-up outputs $Z_1(n)$ and $Z_2(n)$ that target area sounds are included, and determines for the area sound pick-up output $Z_3(n)$ that no target area sound is included. Thus, in the example of FIG. 12, as a result, the area sound pick-up output W(n) generated by the area sound component selection unit 125B includes only a component (component with maximum amplitude for each frequency) selected from the area sound pick-up outputs $Z_1(n)$ and $Z_2(n)$.

As described above, the sound pick-up unit 120B outputs the final output W(n) as a target voice that is picked up from an expanded area. Then, this final output W(n) is output from the communication apparatus 200 (speaker 210) via the communication path P after time transform.

(C-3) Advantageous Effects of Third Embodiment

According to the third embodiment, it is possible to attain the following advantageous effects as compared with the first embodiment.

The sound pick-up unit 120B according to the third embodiment determines for each of a plurality of sound pick-up areas whether or not a target sound is present, and makes zero the gain of the frequency component of an area having no target sound or reduces the gain. This allows the sound pick-up unit 120B according to the third embodiment to prevent unnecessary musical noises or the like from coming in even if sounds are picked up from a plurality of areas, and obtain a uniform and high-quality area sound pick-up result even in an expanded area.

(D) Other Embodiments

The present invention is not limited to the embodiment described above, but can be modified as follows.

(D-1) In each of the embodiments described above, it has been described that the sound pick-up units 120, 120A, and 120B are included as a part of the communication apparatus 100, but may also be configured as an independent apparatus. In addition, in each of the embodiments described above, it has been described that the sound pick-up units 120, 120A, and 120B do not include the microphone array unit 1, but the sound pick-up units 120, 120A, and 120B may be configured as an apparatus integrated with the microphone array unit 1.

(D-2) In each of the embodiments described above, an example has been described in which the sound pick-up apparatus (sound pick-up units 120, 120A, and 120B) according to an embodiment of the present invention is applied to an apparatus or the like including a hand-held transmitter (transmitter and receiver) such as a handset, but the sound pick-up apparatus according to an embodiment of the present invention may be applied to a headset or a wearable device (e.g., head-mounted display equipped with a microphone, neckband headphone equipped with a microphone, or the like), use the region where the mouth of the first user U1 is positioned when worn by the first user U1 as a target area, install a microphone at each vertex of a polygon (N-sided polygon) therearound (mouthpiece), and perform an area sound pick-up process similarly to the embodiments described above.

(D-3) In the embodiments described above, an example of area sound pick-up that uses the three microphones MC1 to MC3 has been shown, but the number of microphones (number of sides (vertices) of a polygon on which microphones are disposed) installed in the microphone array unit 111 is not limited. For example, area sound pick-up from even three directions or four directions increases the number of microphones slightly, resulting in a limited processing amount increase. Specifically, for example, in the embodiments described above, in the case where four microphones are disposed at the respective vertices of a quadrangle, area sound pick-up is performed in the four areas, but the number of microphones is four, which is the same as the minimum two microphone arrays×2 for the conventional area sound pick-up, resulting in simple components and a small process amount. They can be easily implemented in a device such as the handset 110 that has a limited space.

As described above, as the number of microphones (number of vertices of a polygon formed according to the positions of microphones) installed in the microphone array unit 111 increases, the direction of a directionality (direction of the directionality of a BF output) varies. The stability is further grown for fluctuation (fluctuation in the relative positions of the mouthpiece 113 of the handset 110 and the mouth of the first user U1) in the mouth of a speaker (first user U1).

Figure 13:
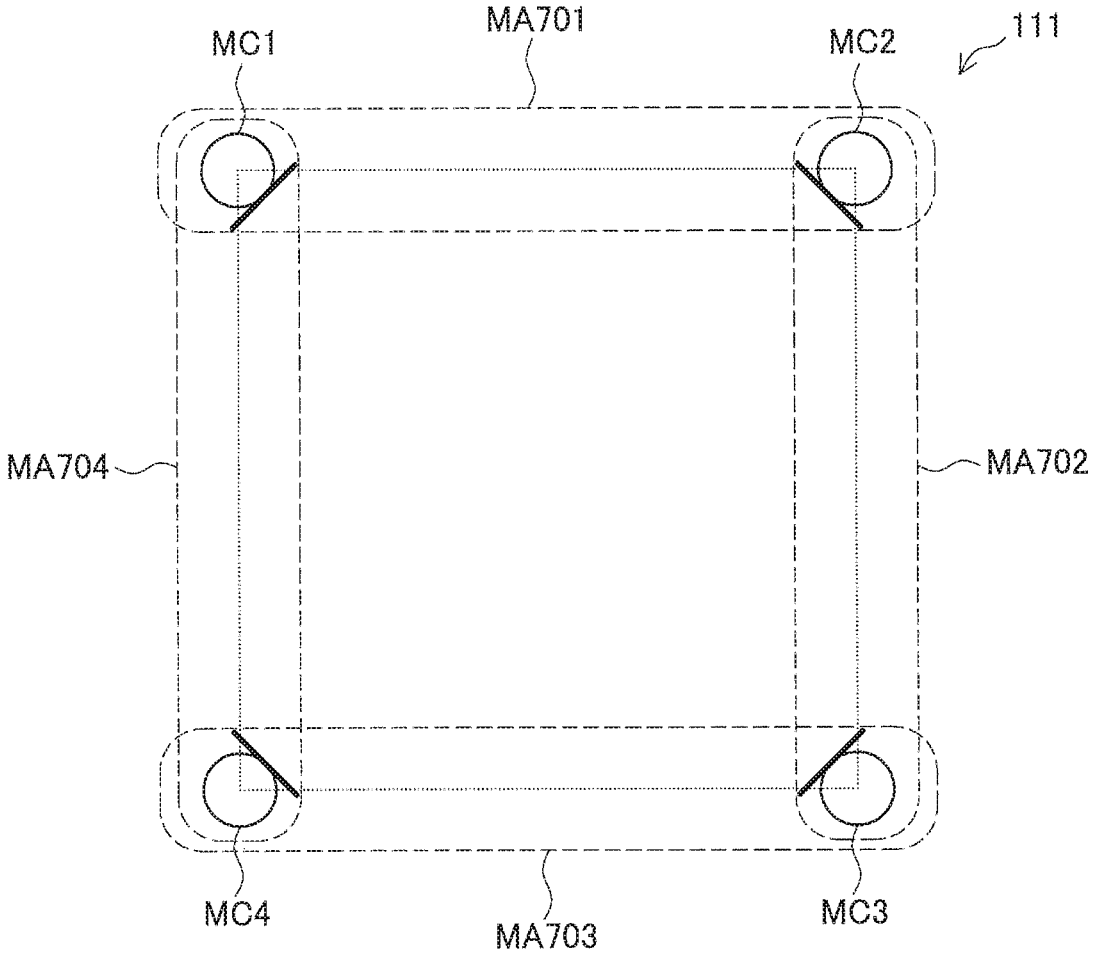
FIG. 13 is an explanatory diagram illustrating a configuration (configuration of a modification according to an embodiment) in a case where a number of microphones in a microphone array unit according to an embodiment is four.
Figure 14:
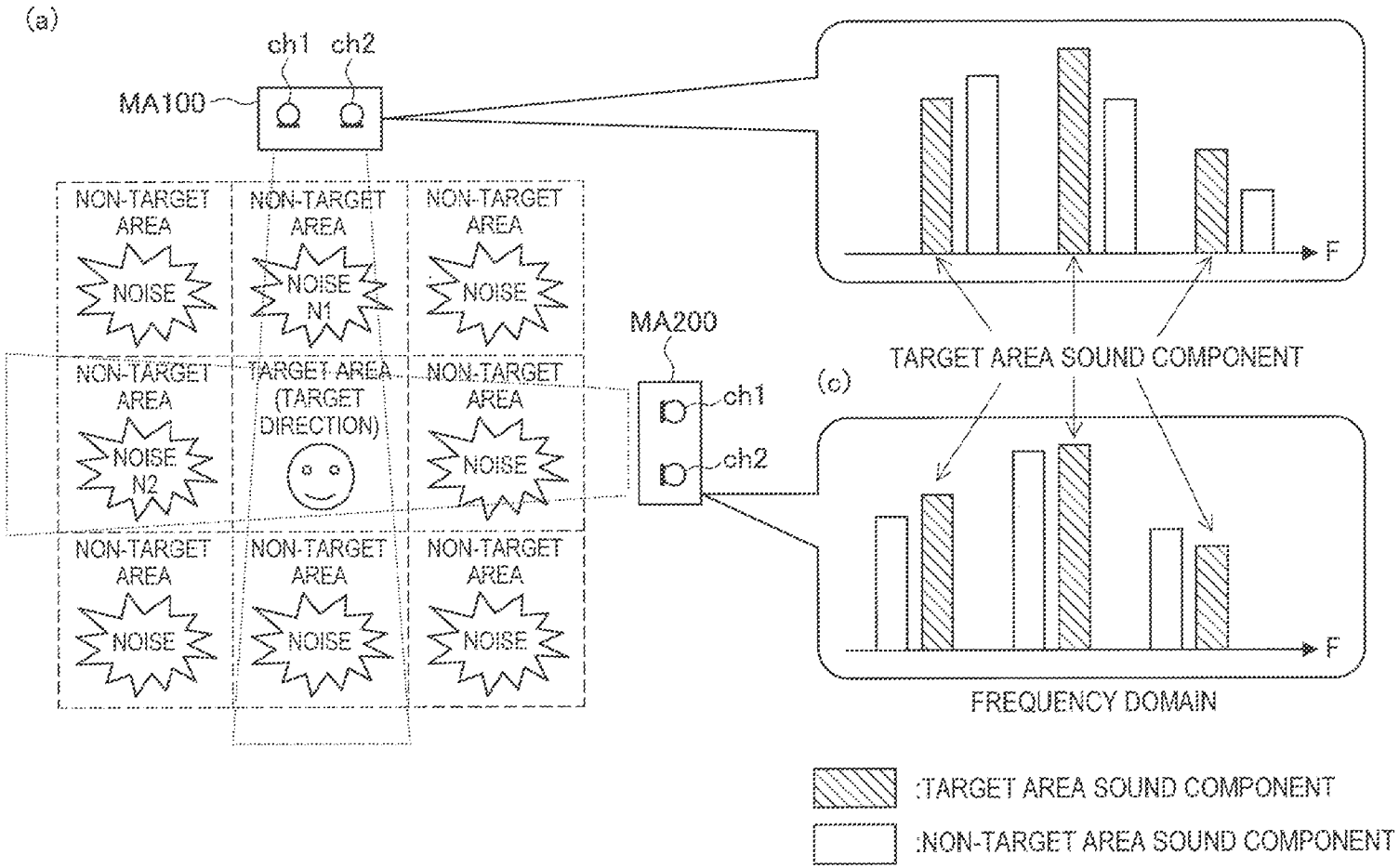
FIG.14 CONVENTIONAL ART
FIG. 14 is an explanatory diagram illustrating a configuration example in a case where directionalities of two microphone arrays are pointed at a target area from different directions with beam formers (BFs) in a conventional sound pick-up apparatus.

FIG. 13 is an explanatory diagram illustrating a configuration in the case where the number of microphones of the microphone array unit 111 is four.

In FIG. 13, the four microphones MC1 to MC4 are disposed at the positions of the respective vertices of a quadrangle (square). The four microphones MC1 to MC4 are combined with the respective adjacent microphones to result in four: a microphone array MA701 including the pair of the microphones MC1 and MC2; a microphone array MA702 including the pair of the microphones MC2 and MC3; a microphone array MA703 including the pair of the microphones MC3 and MC4; and a microphone array MA704 including the pair of the microphones MC4 and MC1. Further, these micro arrays are combined with the respective adjacent microphone arrays (combinations of microphone arrays having some of the microphones in common) to make it possible to perform 4-area sound pick-up. For example, in the case where the configuration of the four microphones MC1 to MC4 is applied to the microphone array unit 111, the sound pick-up unit 120 can acquire the respective outputs (outputs of 4-area sound pick-up) of area sound pick-up with the combination of the microphone arrays MA701 and MA702, area sound pick-up with the combination of the microphone arrays MA702 and MA703, area sound pick-up with the combination of the microphone arrays MA703 and MA704, and area sound pick-up with the combination of the microphone arrays MA704 and MA701. Then, the sound pick-up unit 120 can acquire a sound pick-up result based on the outputs of 4-area sound pick-up described above (e.g., result obtained by integrating four area sound pick-up outputs in accordance with any of the processes according to the first to third embodiments).

The program of the embodiments may be stored in a non-transitory computer readable medium, such as a flexible disk or a CD-ROM, and may be loaded onto a computer and executed. The recording medium is not limited to a removable recording medium such as a magnetic disk or an optical disk, and may be a fixed recording medium such as a hard disk apparatus or a memory. In addition, the program of the embodiments may be distributed through a communication line (also including wireless communication) such as the Internet. Furthermore, the program may be encrypted or modulated or compressed, and the resulting program may be distributed through a wired or wireless line such as the Internet, or may be stored a non-transitory computer readable medium and distributed.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

What is claimed is:

1. A sound pick-up apparatus, comprising:

a target area sound extraction unit configured to extract, from an input signal from a microphone array unit, area sound pick-up outputs, the microphone array unit including three or more microphones, by which two or more microphone arrays are formed, each including at least two microphones, among the three or more microphones, that are so positioned that said each microphone array has a directionality different from a directionality of any of the other microphone arrays, the area sound pick-up outputs being respectively generated by the two or more microphone arrays; and an area sound component selection unit configured to output, as an area sound pick-up result, a result obtained by integrating the area sound pick-up outputs acquired by the target area sound extraction unit, wherein the integrating of the area sound pick-up outputs acquired by the target area sound extraction unit includes comparing the area sound pick-up outputs obtained from the microphone arrays, one with another, for each frequency, and selecting one, among the area sound pick-up outputs, having a component with greatest strength for said each frequency as the area sound pick-up result.

2. The sound pick-up apparatus according to claim 1, wherein the area sound component selection unit performs a determination process with respect to presence or absence of a target area sound for each of the area sound pick-up outputs acquired by the target area sound extraction unit, and acquires the area sound pick-up result on a basis of only an area sound pick-up output for which it is determined that the target area sound is included as a result of the determination process.

3. The sound pick-up apparatus according to claim 2, wherein the area sound component selection unit compares all area sound pick-up outputs determined to include the target area sound by the determination process, one with another, to select the area sound pick-up result.

4. The sound pick-up apparatus according to claim 1, wherein the microphone array unit includes N microphones disposed at positions of respective vertices of an N-sided polygon, where N represents an integer greater than or equal to three.

5. The sound pick-up apparatus according to claim 4, wherein the directionalities of the respective microphone arrays are pointed in a direction toward an inside of the N-sided polygon.

6. The sound pick-up apparatus according to claim 5, further comprising a directionality formation unit configured to, for each microphone, form, with a beam former, a directionality in the direction toward the inside of the N-sided polygon for each input signal input from each microphone array, wherein the target area sound extraction unit is configured to perform:

a non-target area sound extraction process of extracting a non-target area sound present in a target area direction by performing spectral subtraction on a beam former output of each microphone array; and an area sound pick-up process of acquiring an area sound pick-up output by performing spectral subtraction on the non-target area sound from the beam former output of each microphone array.

7. A non-transitory computer-readable storage medium storing an ontology processing program, the ontology processing program causing a computer to function as:

a target area sound extraction unit configured to extract, from an input signal from a microphone array unit, area sound pick-up outputs, the microphone array unit including three or more microphones, by which two or more microphone arrays are formed, each including at least two microphones, among the three or more microphones, that are so positioned that said each microphone array has a directionality different from a directionality of any of the other microphone arrays, the area sound pick-up outputs being respectively generated by the two or more microphone arrays; and an area sound component selection unit configured to output, as an area sound pick-up result, a result obtained by integrating the area sound pick-up outputs-acquired by the target area sound extraction unit, wherein the integrating of the area sound pick-up outputs acquired by the target area sound extraction unit includes comparing the area sound pick-up outputs obtained from the microphone arrays, one with another, for each frequency, and selecting one, among the area sound pick-up outputs, having a component with greatest strength for said each frequency as the area sound pick-up result.

8. A sound pick-up method that is performed by a sound pick-up apparatus including target area sound extraction unit, and an area sound component selection unit, the sound pick-up method comprising:

acquiring, by the target area sound extraction unit, from an input signal from a microphone array unit, area sound pick-up outputs, the microphone array unit including three or more microphones, by which two or more microphone arrays are formed, each including at least two microphones, among the three or more microphones, that are so positioned that said each microphone array has a directionality different from a directionality of any of the other microphone arrays, the area sound pick-up outputs being respectively generated by the two or more microphone arrays; and outputting, by the area sound component selection unit, as an area sound pick-up result, a result obtained by integrating the area sound pick-up outputs acquired by the target area sound extraction unit, wherein the integrating the area sound pick-up outputs acquired by the target area sound extraction unit includes comparing the area sound pick-up outputs obtained from the microphone arrays, one with another, for each frequency, and selecting one, among the area sound pick-up outputs, having a component with greatest strength for said each frequency as the area sound pick-up result.

9. A sound pick-up apparatus, comprising:

a microphone array unit that receives an input signal and outputs two or more area sound pick-up outputs, the microphone array unit including three or more microphones, by which two or more microphone arrays are formed, each including at least two microphones, among the three or more microphones, that are so positioned that said each microphone array has a directionality different from a directionality of any of the other microphone arrays, the two or more microphone arrays respectively generating an area sound pick-up output;

a target area sound extraction unit configured to extract the area sound pick-up outputs from the microphone array unit; and an area sound component selection unit configured to output, as an area sound pick-up result, a result obtained by integrating the area sound pick-up outputs received from the target area sound extraction unit, wherein the integrating of the area sound pick-up outputs acquired by the target area sound extraction unit includes comparing the area sound pick-up outputs obtained from the microphone arrays, one with another, for each frequency, and selecting one, among the area sound pick-up outputs, having a component with greatest strength for said each frequency as the area sound pick-up result.

10. The sound pick-up apparatus according to claim 9, wherein all of the three or more microphones are accommodated in the microphone array unit that is made of one piece.

11. The sound pick-up apparatus according to claim 9, wherein at least one of the three or more microphones is commonly included in two of the two or more microphone arrays.

* * * * *